US005699498A

United States Patent [19]

Noorbakhsh

[11] Patent Number: 5,699,498

[45] Date of Patent: Dec. 16, 1997

[54] TECHNIQUE AND APPARATUS FOR COLOR EXPANSION INTO A NON-ALIGNED 24 BIT RGB COLOR-SPACE FORMAT

[75] Inventor: Ali Noorbakhsh, Danville, Calif.

[73] Assignee: Cirrus Logic, Inc., Fremont, Calif.

[21] Appl. No.: 447,493

[22] Filed: May 23, 1995

[51] Int. Cl.[6] ..... G09G 1/28

[52] U.S. Cl. ..... 395/131; 395/135

[58] Field of Search ..... 395/166, 165, 395/164, 135, 131; 345/154, 153, 150, 186, 185, 187, 191

[56] References Cited

U.S. PATENT DOCUMENTS

| | | | |
|---|---|---|---|
| Re. 34,881 | 3/1995 | Guttag et al. | 345/133 |
| 4,862,150 | 8/1989 | Katsura et al. | 340/703 |
| 4,868,851 | 9/1989 | Trinidad et al. | 375/40 |
| 5,095,301 | 3/1992 | Noorbakhsh | 340/703 |
| 5,162,784 | 11/1992 | Guttag et al. | 340/724 |
| 5,347,631 | 9/1994 | Providenza et al. | 395/16 |
| 5,486,844 | 1/1996 | Randall et al. | 345/113 |

*Primary Examiner*—Phu K. Nguyen
*Assistant Examiner*—Cliff N. Vo
*Attorney, Agent, or Firm*—Victor H. Okumoto; Steven A. Shaw

[57] ABSTRACT

A computer system includes a host processor, a system memory, a display unit, a pointer device, a VGA controller, and a display memory. The VGA controller communicates with the display memory through an 8-byte wide data bus such that each byte is controlled by a separate column address strobe. To perform a BitBLT operation on a monochrome pattern to be logically combined with 888-RGB color-space formatted data in the display memory, the VGA controller includes a BitBLT control for generating numerous control signals; a color expand circuit for generating in response to such control signals, an 8-byte wide pattern of 888-RGB color-space formatted foreground color data; a circuit for logically combining in response to such control signals, the 8-byte wide pattern of 888-RGB color-space formatted foreground color data and a corresponding 8-byte wide pattern of 888-RGB color-space data received from the 8-byte wide data bus; a bit align circuit for generating in response to such control signals, column address strobe values indicative of bits of the monochrome pattern corresponding to the 8-byte wide pattern of 888-RGB color-space data received from the data bus, by bit aligning the bits of the monochrome pattern; and a memory sequencer for generating in response to such control signals, column address strobe signals corresponding to the values received from the bit align circuit, for strobing into the display memory selected bytes of the logically combined 8-bytes of data.

21 Claims, 19 Drawing Sheets

TECHNIQUE AND APPARATUS FOR COLOR EXPANSION INTO A NON-ALIGNED 24 BIT RGB COLOR-SPACE FORMAT

BACKGROUND OF THE INVENTION

This invention relates in general to video graphics array controllers included in computer systems and in particular, to video graphics array controllers with bit boundary block transfer engines or hardware accelerators.

Video graphics array ("VGA") controllers are useful in computer systems for performing certain display control functions, thus freeing up host processors in the computer systems to perform other tasks. For example, a VGA controller may facilitate such activities as host processor access to display memory and registers in the VGA controller, and screen refresh and display memory DRAM refresh functions.

Bit boundary block transfer ("BitBLT") engines are useful in VGA controllers for accelerating BitBLT operations. In general terms, a BitBLT operation involves a block data transfer such as, for example, moving a rectangle of data from one area of a display memory to another area of the display memory. More particularly, a BitBLT operation comprises a sequence of steps including reading data from a source memory area and data from a destination memory area, logically combining the data respectively read from the source memory area and the destination memory area using one of a number of logical operations generally referred to as raster operations ("ROPs"), and writing the result of the logical operation into the destination memory area.

The source memory area may be physically located in either a system memory, generally accessible to components in the computer system via a system bus, or a display memory, generally only directly accessible to the VGA via a private or internal bus. The destination memory area is generally physically located in the display memory. The display memory stores information used to update a screen of display data for a display unit such as a cathode ray tube ("CRT") or a liquid crystal display ("LCD").

Each screen of display data defines an array of pixels such as 640×480, 800×600, 1024×768, or 1280×1024 resolution. Each pixel is generally represented by a number of bits in display memory which indicate a color corresponding to that pixel. Accordingly, the number is commonly referred to as the pixel depth or color depth. In a monochrome format, only one bit is allocated for each pixel. Therefore, only two colors may be indicated by the one bit. For example, when the bit is "1" a predefined foreground color may be indicated, and when the bit is "0" a predefined background color may be indicated.

In a multi-color format, a plurality of bits are allocated for each pixel, and the number of colors which may correspond to each pixel is determined from the number of bits. In particular, if n bits are allocated for each pixel, the color of each pixel may be indicated from $2^n$ predefined colors. In an RGB color-space format, a plurality of bits are allocated for each of the three colors, red, green, and blue. For example, in an 888-RGB color-space format, 24 bits (3 bytes) are allocated for each pixel. The first 8-bits or byte is indicative of one of 256 shades of red, the second 8-bits or byte is indicative of one of 256 shades of green, and the third 8-bits or byte is indicative of one of 256 shades of blue. In a similar fashion, a 555-RGB color-space format and a 556-RGB color-space format can be defined.

In certain applications, a monochrome pattern such as an icon or text is superimposed on a color display screen generated from multi-color display data specified in an 888-RGB color-space format. To accomplish such, a bitBLT operation may be performed wherein the monochrome pattern is read from the source memory area, and 888-RGB color-space data corresponding to the area of the screen wherein the monochrome pattern is to be superimposed is read from the destination memory area; the monochrome pattern is color expanded into 888-RGB color-space formatted data using predefined foreground and background red, green, and blue colors; the color expanded monochrome data is byte aligned with the 888-RGB color-space format data read from the destination memory area; the color expanded and byte aligned monochrome data is logically combined with the 888-RGB color-space format data read from the destination memory area; and the result of the logical operation is written back into the destination memory area replacing the data corresponding to the area of the screen wherein the monochrome pattern is to be superimposed.

Color expansion of the monochrome data into 888-RGB color-space formatted data using predefined foreground and background red, green, and blue colors generally requires that the bit representing each pixel of the monochrome pattern be expanded into three bytes, one byte for red, one byte for green, and one byte for blue, when the bit is a binary 1, for example, the bit may be expanded to three bytes wherein the first, second, and third bytes respectively indicate predefined red, green, and blue foreground colors. On the other hand, when the bit is a binary 0, the bit may be expanded to three bytes wherein the first, second, and third bytes respectively indicate predefined red, green, and blue background colors.

Data stored in the display memory may be logically addressed by linearly addressed bytes to simplify programming code manipulating the data. For example, bytes B00 to R08 are shown in FIG. 7 to be linearly addressed from A0000 (hex) to A001A (hex). The data stored in the display memory may also be addressed by row, column, and plane to physically access the data through read and write requests from and to the display memory. For example, data stored in DRAMs 22-1 to 22-4 are described in reference to FIG. 8 to be addressed by row (row address provided on address bus 202 and strobed into row address buffers when row address strobe signal RAS-bar is activated LOW), by column (column address provided on address bus 202 and strobed into column address buffers when column address strobe signals CAS(0)-bar to CAS(7)-bar are activated LOW), and by plane (8 bytes at a time for each row and column address). when both such logical and physical addressing schemes are being employed, translating means between one and the other is required. Examples of such translating means include a processor conducting calculations based upon a predefined algorithm, or cross-referencing the two sets of addresses through a predefined look-up table.

When 888-RGB color-space formatted data is read from or written to a display memory through a data bus which is 8-bytes wide, such as the data bus 210 in FIG. 8, 888-RGB color-space format data for two and two-thirds pixels are communicated through the data bus each time. Referring to FIG. 7, for example, in a first 8 byte wide D00–D63 read from the display memory, complete 888-RGB color-space format data for pixels P(0,0) and P(0,1) are read, and only the blue and green bytes for pixel P(0,2) is read; in a second 8-byte wide D00–D63 read from the display memory, the red byte for pixel P(0,2) is read, complete 888-RGB color-space format data for pixels P(0,3) and P(0,4) are read, and only the blue byte for pixel P(0,5) is read; in a third 8-byte wide D00–D63 read from the display memory, the green and red bytes for pixel P(0,5) are read, and complete 888-RGB color-space format data for pixels P(0,6) and P(0,7) are read. The pattern would thereafter repeat for each successive series of three reads.

As a consequence, the first byte of the 888-RGB color expanded monochrome pattern may not correspond to the same pixel on a display screen as the first byte of the 8-byte wide D00–D63 read from the display memory. Referring to FIG. 7, for example, the first byte of the 888-RGB color expanded monochrome pattern may correspond to a pixel P(0,1), whereas the first byte in the first 8-byte wide D00–D63 read from the display memory may correspond to a pixel P(0,0). Accordingly, the color expanded monochrome pattern must be properly aligned with the data read from the destination memory area before logically combining the two.

In particular, before logically combining the 888-RGB color expanded monochrome pattern with the 888-RGB color-space formatted data read in an 8-byte wide read from the display memory, the 888-RGB color expanded monochrome pattern must be shifted an appropriate number of bytes to the right. For example, if the monochrome pattern is to be superimposed on an area of the screen starting with pixel P(0,1), then the color expanded monochrome pattern must be shifted three bytes to the right before logically combining it with the data from the display memory; if the monochrome pattern is to be superimposed on an area of the screen starting with pixel P(0,2), then the color expanded monochrome pattern must be shifted six bytes to the right before logically combining it with the data from the display memory; if the monochrome pattern is to be superimposed on an area of the screen starting with pixel P(0,3), then the color expanded monochrome pattern must be shifted one byte to the right before logically combining it with the data from the display memory; and so forth. When the color expanded monochrome pattern is thus shifted, any shifted out bytes are saved and concatenated onto a subsequent color expanded monochrome pattern.

FIG. 9*a* illustrates, as an example, a block diagram of certain portions of a prior art BitBLT engine performing the above described color expansion and byte alignment functions. In the example, it is assumed that color information for each pixel of a display screen is stored in a display memory using the 888-RGB color-space format. For processing purposes, it is further assumed that each byte of the 888-RGB color data is linearly addressed as shown, for example, in FIG. 7. A linearly addressed location referred to herein as a destination start address ("DSA") corresponds to a first byte of 888-RGB color-space formatted data corresponding to a first pixel on the display screen to be operated upon.

When a BitBLT operation is to be performed, a byte of a monochrome pattern is stored in a register 1102, and a destination start address corresponding to the 888-RGB color-space formatted data that it is to be logically combined with is stored in register 1126. Bytes of data corresponding to predefined red, green, and blue foreground colors are stored in designated locations in three foreground registers 1114, 1116 and 1118, and bytes of data corresponding to predefined red, green, and blue background colors are stored in designated locations in three background registers 1120, 1122 and 1124.

Each of the three foreground registers 1114, 1116 and 1118 and each of the three background registers 1120, 1122 and 1124 corresponds to one of three possible 8-byte wide reads or writes to display memory. For example, referring to FIG. 7, a first 8-byte wide read having a starting display address A0000 comprises a RGB sequence similar to that of foreground and background registers 1114 and 1120; a second 8-byte wide read having a starting display address A0008 comprises a RGB sequence similar to that of foreground and background registers 1116 and 1122; and a third 8-byte wide read having a starting display address A0010 comprises a RGB sequence similar to that of foreground and background registers 1118 and 1124. Each subsequent series of three byte reads follows the same pattern with the first byte read comprising a RGB sequence similar to that of foreground and background registers 1114 and 1120; the second byte read comprising a RGB sequence similar to that of foreground and background registers 1116 and 1122; and the third byte read comprising a RGB sequence similar to that of foreground and background registers 1118 and 1124.

A multiplexer ("MUX") 1104 has inputs connected to the three foreground registers 1114, 1116 and 1118, and a MUX 1106 has inputs connected to the three background registers 1120, 1122 and 1124. A decoder 1112 decodes the three least-significant-bits ("LSBs") of the DSA stored in the register 1126, and generates select signals provided to select signal inputs of the MUXs 1104 and 1106. In practice, the decoder 1112 may take the form of a look-up table ("LUT") such as the following example illustrated in Table I, or hard-wired logic performing such function, or a processor performing a predefined algorithmic calculation accomplishing same. In the following example, a select signal pair "00" passes the contents of foreground register 1114 and background register 1120 through their respective MUXs 1104 and 1106, a select signal pair "01" passes the contents of foreground register 1116 and background register 1122 through their respective MUXS 1104 and 1106, and a select signal pair "10" passes the contents of foreground register 1118 and background register 1124 through their respective MUXs 1104 and 1106.

TABLE I

Decoder 1112.

| DSA Address (hex) | 3 LSBs of DSA (base 2) | Select Signals |
|---|---|---|
| A0000 | 000 | 00 |
| A0003 | 011 | 00 |
| A0006 | 110 | 00 |
| A0009 | 001 | 01 |
| A000C | 100 | 01 |
| A000F | 111 | 01 |
| A0012 | 010 | 10 |
| A0015 | 101 | 10 |

A MUX 1108 has inputs connected to the outputs of MUXs 1104 and 1106, and passes bytes from one or the other to a byte aligner 1110. In particular, if a bit stored in the monochrome pattern register 1102 is to be color expanded into a foreground color as indicated, for example, by the bit being "1", a corresponding byte from the appropriate foreground register 1114, 1116, or 1118 will be passed by the MUX 1108 to the byte aligner 1110, and if the bit stored in the monochrome pattern register 1102 is to be color expanded into a background color as indicated, for example, by the bit being "0", a corresponding byte from the appropriate background register 1120, 1122, or 1124 will be passed by the MUX 1108 to the byte aligner 1110.

Select logic 1109 is connected to the monochrome pattern register 1102, and generates in response to the bits stored therein, select signals s7–s0 for controlling the MUX 1108.

In particular, for each bit stored in the monochrome pattern register 1109, the select logic 1109 generates an appropriate shelf select signals s7–s0 which cause the MUX 1108 to pass a corresponding byte from either the foreground register contents being passed to it from the MUX 1104, or the background register contents being passed to it from the MUX 1106.

FIG. 9*b* illustrates, as an example, a block diagram of the MUX 1108. In the example, the MUX 1108 comprises a plurality of MUXs 1108-0 to 1108-7. Each of the MUXs 1108-0 to 1108-7 receives a corresponding byte from the foreground MUX 1104 and the background MUX 1106, and a corresponding select signal from the select logic 1109. For example, if the contents of registers 1114 and 1120 are initially being passed respectively by the MUXs 1104 and 1106, the MUX 1108 passes either the first three bytes "BGR" (from left to right) from the foreground register 1114 or the first three bytes "bgr" (from left to right) from the background register 1120, depending upon whether the seventh bit of a byte of monochrome pattern data currently being color expanded is a "1" or a "0"; passes either the second three bytes "BGR" (from left to right) from the foreground register 1114 or the second three bytes "bgr" (from left to right) from the background register 1120, depending upon whether the sixth bit of the byte of monochrome pattern data is a "1" or a "0"; and passes the last two bytes "BG" (from left to right) from the foreground register 1114 or the last two bytes "bg" (from left to right) from the background register 1120, depending upon whether the fifth bit of the byte of monochrome pattern data is a "1" or a "0".

After passing the contents of registers 1114 and 1120, MUXs 1104 and 1106 next respectively pass the contents of registers 1116 and 1122 to the MUX 1108. The select logic 1109 keeps track that the color information for the fifth bit of the byte of monochrome pattern data has not been completed since only two bytes "BG" from the foreground register 1114 or two bytes "bg" from the background register 1120 had been previously passed to the byte aligner 1110. Accordingly, the select logic 1109 generates appropriate select signals s7–s0 such that the MUX 1108 passes the first byte "R" (from left to right) of the foreground register 1116 or the first byte "r" (from left to right) of the background register 1122, depending upon whether the fifth bit of the byte of monochrome pattern data is a "1" or a "0"; passes either the next three bytes of "BGR" (from left to right) of the foreground register 1116 or the next three bytes of "bgr" (from left to right) of the background register 1122, depending upon whether the fourth bit of the byte of monochrome pattern data is a "1" or a "0"; passes either the second next three bytes of "BGR" (from left to right) of the foreground register 1116 or the second next three bytes of "bgr" (from left to right) of the background register 1122, depending upon whether the third bit of the byte of monochrome pattern data is a "1" or a "0"; and passes the last byte "B" (from left to right) of the foreground register 1114 or the last byte "b" (from left to right) of the background register 1120, depending upon whether the second bit of the byte of monochrome pattern data is a "1" or a "0".

After passing the contents of registers 1116 and 1122, MUXS 1104 and 1106 next respectively pass the contents of registers 1118 and 1124 to the MUX 1108. The select logic 1109 keeps track that the color information for the second bit of the byte of monochrome pattern data has not been completed since only one byte "B" from the foreground register 1116 or one byte "b" from the background register 1122 had been previously passed to the byte aligner 1110. Accordingly, the select logic 1109 generates appropriate select signals s7–s0 such that the MUX 1108 passes the first two bytes "GR" (from left to right) from the foreground register 1118 or the first two bytes "gr" (from left to right) from the background register 1124, depending upon whether the second bit of the byte of monochrome pattern data is a "1" or a "0"; passes either the next three bytes of "BGR" (from left to right) from the foreground register 1118 or the next three bytes of "bgr" (from left to right) from the background register 1124, depending upon whether the first bit of the byte of monochrome pattern data is a "1" or a "0"; and passes either the second next three bytes of "BGR" (from left to right) from the foreground register 1118 or the second next three bytes of "bgr" (from left to right) from the background register 1124, depending upon whether the zeroth bit of the byte of monochrome pattern data is a "1" or a "0".

The byte aligner 1110 has inputs connected to the passed outputs of the logic MUX 1108. Depending upon the DSA stored in the register 1126, the byte aligner 1110 shifts, if necessary, the 8 bytes passed by the logic MUX 1108 to the right so that the first three bytes of "BGR" or "bgr" is positioned in a byte location corresponding to the DSA, with any shifted out bytes stored in an alignment register 1128 included in the byte aligner 1110. To keep track of such shifting requirements, the byte aligner 1110 may include decoder logic, or a look-up table such as shown in Table II below, or simply perform calculations based upon a predefined algorithm accomplishing the same.

TABLE II

Byte Aligner 1110 decoder function.

| DSA (hex) | Number of Bytes Shifted to Right | DSA (hex) | Number of Bytes Shifted to Right |
|---|---|---|---|
| A0000 | 0 | A000C | 4 |
| A0003 | 3 | A000F | 7 |
| A0006 | 6 | A0012 | 2 |
| A0009 | 1 | A0015 | 5 |

Since the pattern illustrated in Table II repeats for each series of 8 consecutive pixels along a row, the number of bytes to be shifted to the right can be calculated, for example, by adding multiples of 24 (base 10) to each of the eight destination starting addresses illustrated in Table II. A hard-wired decoder circuit may also be readily designed to accomplish such function.

FIG. 9*c* illustrates, as an example, certain portions of the byte aligner 1110 to further clarify its function and operation. A plurality of MUXs, 1110-00 to 1110-14, each receive the 8 bytes of color data passed by the MUX 1108, and passes in response to its corresponding select signals, one or none of the 8 bytes received. The alignment register 1128 comprises a plurality of flip-flops or latches, 1128-0 to 1128-6, each receiving a byte of data respectively from corresponding, MUXs 1108-08 to 1108-14. A compactor or cross-point switch 1127 receives the fifteen bytes of data, one each from MUXs 1110-00 to 1110-07 and one each from flip-flops 1128-0 to 1128-6, and compacts them into 8 bytes of data representing the color expanded and byte aligned data to be logically combined with data from the destination memory. Select signals S00-S14 controlling the MUXs, 1110-00 to 1110-14, and enable signals e0–e6 controlling the flip-flops, 1128-0 to 1128-6, are generated by byte aligner logic (not shown) including, for example, the decoder logic or a look-up table function illustrated in Table II.

If the DSA is A0003, for example, the byte aligner logic (not shown) would generate select signals S00–S14 and enable signals e0 to e6 such that MUXs, 1110-03 to 1110-10, and flip-flops, 1128-0 to 1128-3, pass the eight bytes of color information received from the MUX 1108, and the remaining MUXs, 1110-0 to 1110-2 and 1110-11 to 1110-14, and remaining flip-flops, 1128-4 to 1128-6, either pass none of the color bytes received from the MUX 11108 or pass a byte which is subsequently ignored or deleted by the compactor 1127. In particular, if the DSA is A0003, the MUX 1110-3 passes the first of eight bytes of color received from the MUX 1108 (e.g., either a foreground or background color blue), the MUX 1110-4 passes the second of eight bytes of color received from the MUX 1104 (e.g., either a foreground or background color green), the MUX 1110-5 passes the third of eight bytes of color received from the MUX 1108 (e.g., either a foreground or background color red), the MUX 1110-6 passes the fourth of eight bytes of color received from the MUX 1108 (e.g., either a foreground or background color blue), the MUX 1110-7 passes the fifth of eight bytes of color received from the MUX 1108 (e.g., either a foreground or background color green), the MUX 1110-8 passes the sixth of eight bytes of color received from the MUX 1108 (e.g., either a foreground or background color red), the MUX 1110-9 passes the seventh of eight bytes of color received from the MUX 1108 (e.g., either a foreground or background color blue), and the MUX 1110-10 passes the eighth of eight bytes of color received from the MUX 1108 (e.g., either a foreground or background color green). In addition, the flip-flop 1128-0 stores the color passed by MUX 1110-08, the flip-flop 1128-1 stores the color passed by MUX 1110-9, and the flip-flop 1128-2 stores the color passed by MUX 1110-10. Timing of the enable signals e0–e6 are such that the bytes of data stored in the flip-flops, 1128-0 to 1128-2, are provided to the compactor 1127 while the MUXS, 1110-00 to 1110-14 are passing a subsequent eight bytes of color data received from the MUX 1108.

OBJECTS AND SUMMARY OF THE INVENTION

In designing integrated circuits, it is an ongoing design goal to reduce the size of integrated circuits providing a given functionality. It is especially desirable to achieve such size reduction by reducing the complexity (or number of transistors) of the integrated circuitry performing the function or a comparable function.

Accordingly, one object of the present invention is a BitBLT engine or accelerator including color expansion and byte alignment, or comparable functions, which is simpler in construction than prior art BitBLT engines including such functions.

Another object is a BitBLT engine or accelerator including color expansion and byte alignment, or comparable functions, which is faster than prior art BitBLT engines including such functions.

These and additional objects are accomplished by the various aspects of the present invention, wherein briefly stated, one aspect of the invention is a controller connected to a memory storing red, green, and blue color data for individual pixels of a display screen. Included in the controller are: means for storing data indicative of predefined shades of red, green, and blue; means for receiving monochrome color data for indicated pixels of the display screen; means for receiving red, green, and blue color data from the memory, for the indicated pixels of the display screen; means for logically combining the received color data and corresponding ones of the predefined shades of red, green, and blue; and means for generating a plurality of column address strobe signals from the received monochrome color data such that the generated plurality of column address strobe signals cause the logically combined color data to replace stored red, green, and blue color data in the memory for selected ones of the indicated pixels as determined by the monochrome color data.

Another aspect of the invention is a method of performing a BitBLT operation on indicated pixels of a display screen, comprising: receiving data indicative of predefined shades of red, green, and blue; receiving monochrome color data for the indicated pixels of the display screen; receiving red, green, and blue color data from a memory, for the indicated pixels of the display screen; logically combining the received color data and corresponding ones of the predefined shades of red, green, and blue; and generating a plurality of column address strobe signals from the received monochrome color data such that the generated plurality of column address strobe signals cause the logically combined color data to replace stored red, green, and blue color data in the memory for selected ones of the indicated pixels as determined by the monochrome color data.

Still another aspect of the invention is a computer system comprising: a host processor; a display having a display screen with a number of pixels; a memory storing red, green, and blue color data for individual pixels of the display screen; and a controller. Included in the controller are: means for storing data indicative of predefined shades of red, green, and blue; means for receiving monochrome color data for indicated pixels of the display screen; means for receiving red, green, and blue color data from the memory, for the indicated pixels of the display screen, means for logically combining the received color data and corresponding ones of the predefined shades of red, green, and blue; and means for generating a plurality of column address strobes from the received monochrome data such that the generated plurality of column address strobes cause the logically combined color data to replace stored red, green, and blue color data in the memory for selected ones of the indicated pixels as determined by the monochrome color data.

Additional objects, features and advantages of the various aspects of the present invention will become apparent from the following description of its preferred embodiment, which description should be taken in conjunction with the accompanying drawings.

DETAILED DESCRIPTION OF THE PREFERRED EMBODIMENT

Figure 1:
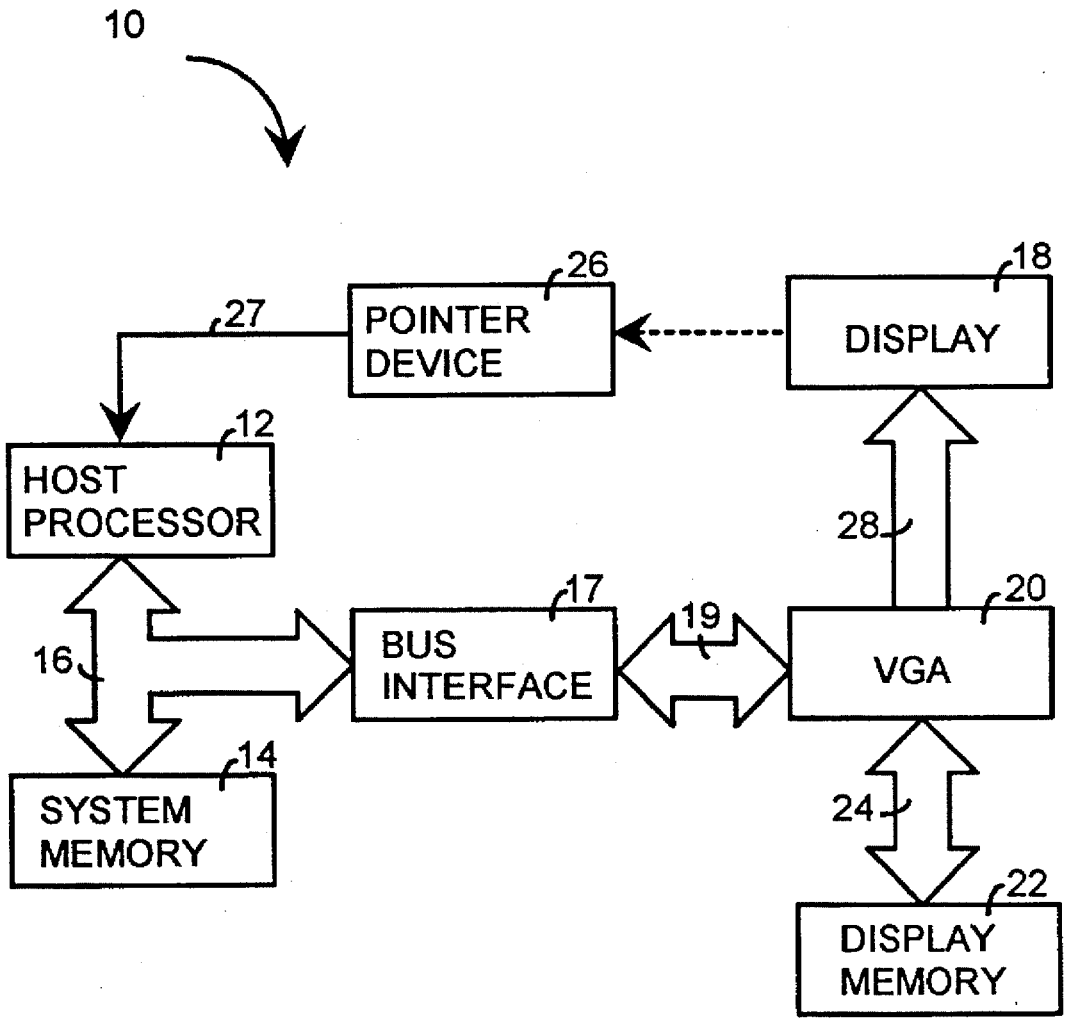
FIG. 1 illustrates, as an example, a block diagram of a computer system utilizing aspects of the present invention.

FIG. 1 illustrates, as an example, a block diagram of a computer system 10. Included in the computer system 10 are a host processor 12 for performing certain processing functions, a display unit 18 and a pointer device 26 for facilitating user interaction with the host processor 12, a video graphic adapter ("VGA") 20 for performing certain video processing and display control functions, and a bus interface 17 through which the host processor 12 communicates with the VGA controller 20. Also included in the computer system 10 are system memory 14 and display memory 22 for storing, among other things, certain display data to be processed by the VGA controller 20. A system bus 16 facilitates communication between the host processor 12, the system memory 14, and the bus interface 17. Analog lines 27 facilitate communication between the pointing device and the host processor 12. A subsystem bus 19 facilitates communication between the bus interface 17 and the VGA controller 20. An internal memory bus 24 facilitates communication between the VGA controller 20 and the display memory 22. An analog bus 28 facilitates communication between the VGA controller 20 and the display unit 18.

The host processor 12 is preferably one of a number of commercially available microprocessors such as those marketed, for example, by Intel and Motorola. The display unit 18 is preferably a VGA compatible color unit such as, for examples, certain cathode ray tubes ("CRTs") and liquid crystal displays ("LCDs"). The pointer device 26 is preferably a mouse or track ball type device suitable for pointing to locations on the display unit 18 and communicating signals indicative of those locations to the host processor 12. The subsystem bus 19 may be any one of a number of buses such as an ISA, VESA® VL-Bus™, or Intel®-PCI bus.

Figure 2:
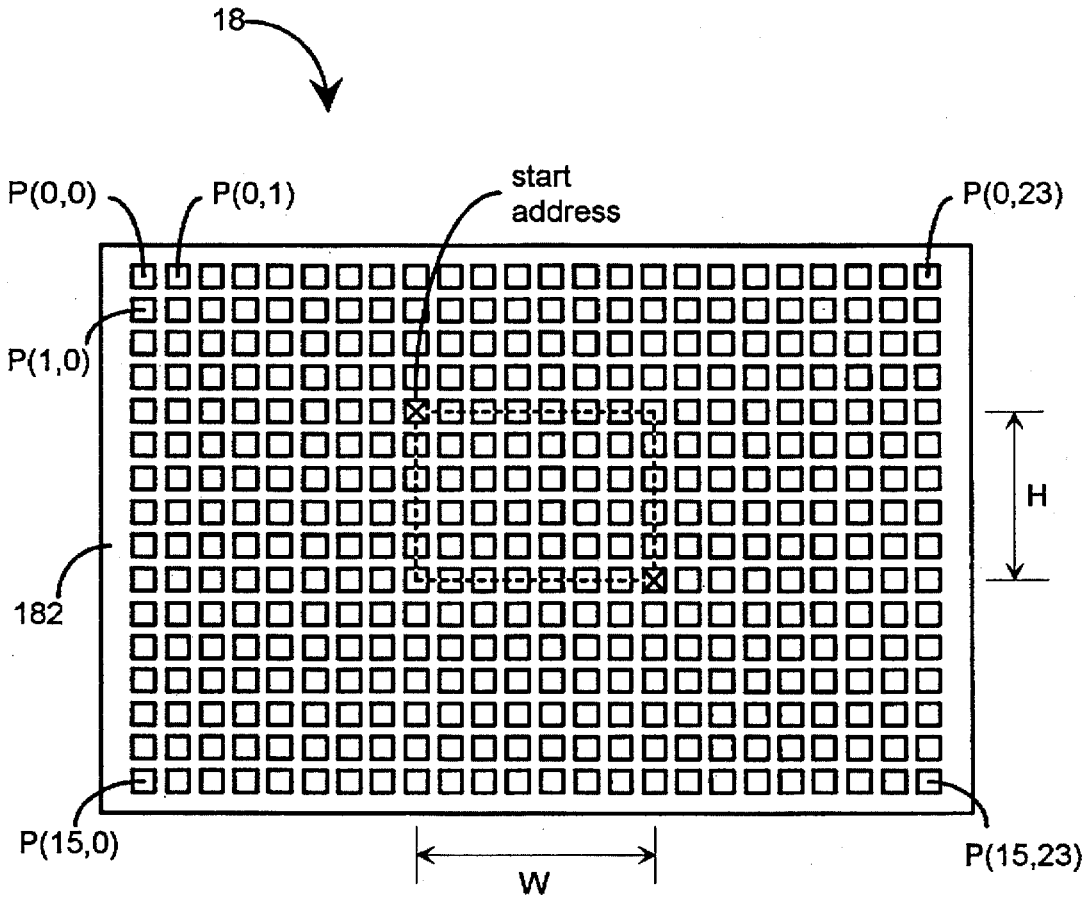
FIG. 2 illustrates, as an example, a portion of a screen display of a display device.

FIG. 2 illustrates, as an example, a portion of a screen display 182 of the display unit 18. In particular, an array of pixels comprising sixteen rows (numbered 0 to 15) and twenty-four columns (numbered 0 to 23) is depicted wherein the rows are incremented from top to bottom and the columns are incremented from left to right such that a pixel denoted as P(0,0) is located in the first row and first column of the array, and a pixel denoted as P(15,23) is located in the sixteenth row and twenty-fourth column of the array. A full screen display may generally include a pixel array of 640×480 pixels, 800×600 pixels, 1024×768 pixels, or 1280×1024 pixels.

Also depicted on the screen display 182 is a rectangle or block of pixels defined, for example, by user manipulation of the pointer device 26. The block is identified by a start address, a width "W", and a height "H". In this case, the start address is referred to as a destination start address and is defined as the address in display memory 22 containing a first byte of 888-RGB color-space formatted data corresponding to a pixel (e.g., P(4,8)) indicated by an X in the upper left hand corner of the dotted rectangle. The destination start address is generally selected by "dragging" the pointer device 26 to the pixel indicated by the X in the upper left hand corner of the dotted rectangle, and clicking a button associated with the pointer device 26. Driver software for the pointer device 26 and the VGA controller 20 then maps the thus selected pixel to a destination start address in the display memory 22 and provides such address via system bus 16 so that it may be stored in a register 224-11 in the VGA controller 20 by the host processor 12. Also in this case, the width "W" is generally the number of bytes corresponding to the number of pixels in the horizontal direction of the dotted rectangle, and the height "H" is generally the number of bytes corresponding to the number of pixels in the vertical direction of the dotted rectangle. The driver software for the VGA controller 20 may also calculate these values and provide the width "W" and height "H" via system bus 16 so that they may be respectively stored in registers 224-7 and 224-8 in the display memory 22 by the host processor 12.

Figure 3:
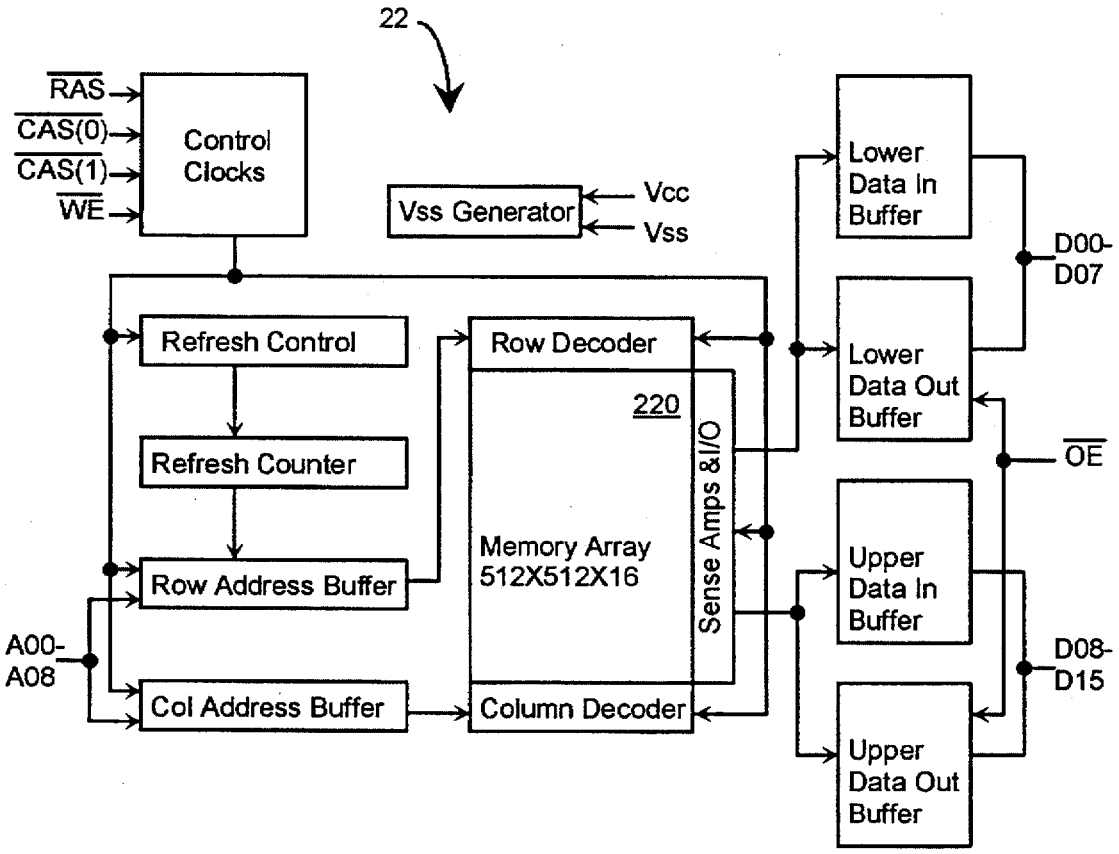
FIG. 3 illustrates, as an example, a block diagram of a 256 k×16 random-access-memory device.

FIG. 3 illustrates, as an example, a block diagram of a 256 k×16 dynamic-random-access memory ("DRAM") preferably included in the display memory 22. An example of such a device is the KM416C256 256 k×16 Bit CMOS Dynamic RAM with Fast Page Mode marketed by Samsung Electronics, wherein all publicly available information on such device is incorporated herein by this reference.

Figure 4:
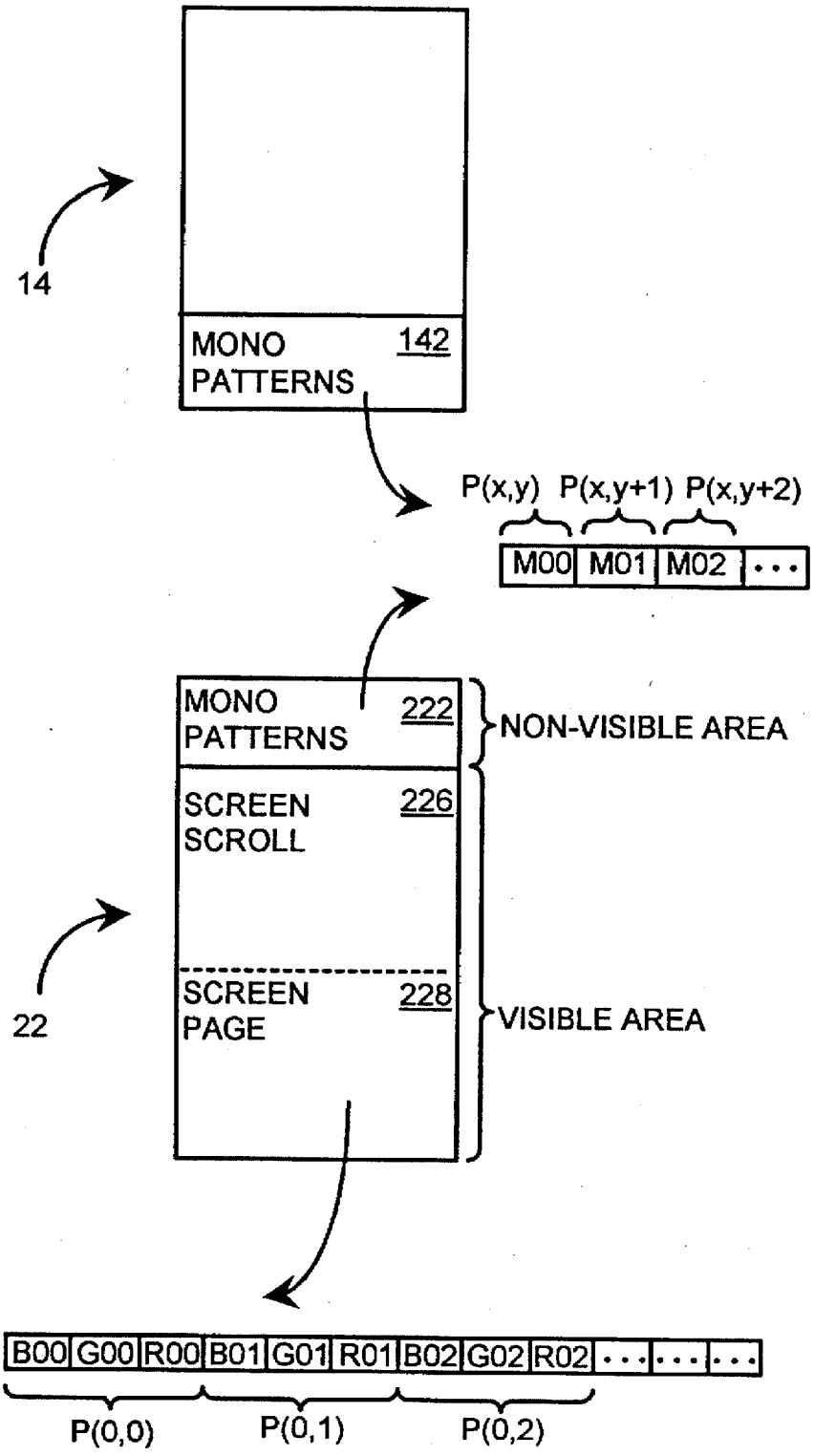
FIG. 4 illustrates, as examples, certain display data stored the system memory and the display memory.

FIG. 4 illustrates, as examples, certain display data stored the system memory 14 and the display memory 22. As previously described, monochrome patterns may be stored in an area 142 of the system memory 14, or they may be stored in an area 222 of the display memory 22. When stored in the system memory 14 as one bit per pixel, the functions of color expansion and byte alignment are especially appreciated in a BitBLT engine included in the VGA controller 20. For example, if the data were stored in 888-RGB color-space format in the system memory 14, the information for 8 pixels would require the storage of 24 bytes of data. On the other hand, if the data is stored in monochrome format in the system memory 14, the information for 8 pixels would only require the storage of 8 bits or one byte of data. Thus, a 24-to-1 reduction in the amount of data required to be stored in the system memory 14 is accomplished and accordingly, a comparable reduction in the amount of data required to be transmitted to the VGA controller 20 by the host processor 12 is accomplished. This frees up the host processor 12 to perform other tasks.

The display memory 22 stores certain information required to display a screen of data on the display unit 18. In particular, one or more pages of screen data are stored in an area of the display memory 22 which is referred to as the "visible area", and other data used for updating the screen data are stored in another area of the display memory 22 which is referred to as the "non-visible area". The visible area includes a page of data 228 for the currently displayed screen on the display unit 18, and a fraction of a page or up to several additional pages of data 226 for data which can be scrolled onto the screen of the display unit 18. The non-visible area includes an area 222 for monochrome patterns. As shown in FIG. 4, the data pages for the screen include 888-RGB color-space formatted data for each pixel on the display screen.

Figure 5A:
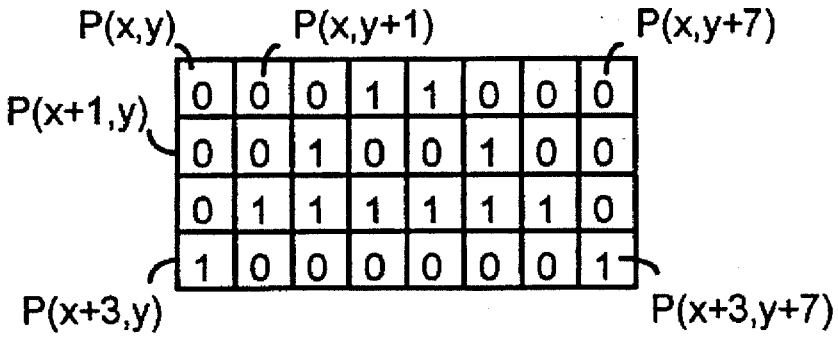
FIGS. 5*a* and 5*b* illustrate, as examples, two monochrome patterns which may be physically stored in either system memory or display memory.
Figure 5B:
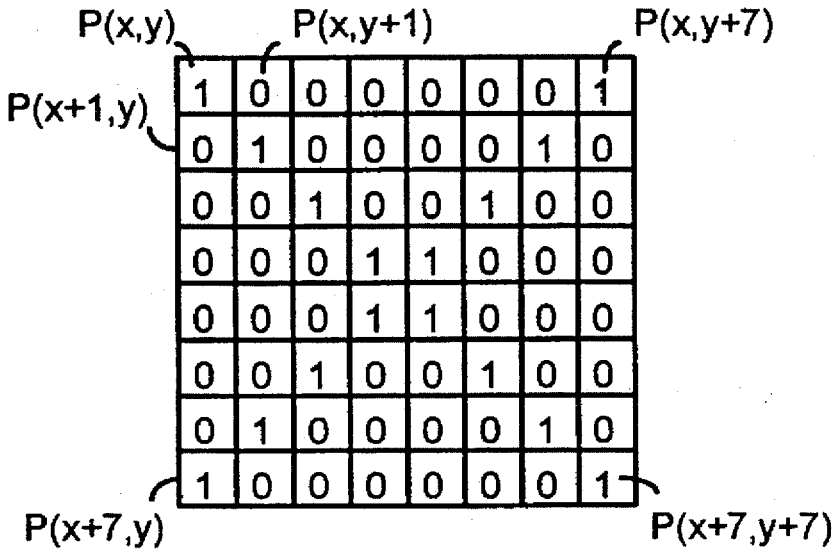

FIGS. 5*a* and 5*b* illustrate, as examples, two monochrome patterns which may be physically stored in either system memory 14 or display memory 22. In particular, FIG. 5*a* illustrates a first monochrome pattern resembling the letter "A" as defined by various "1's" and "0's" indicated in four rows of one byte each, and FIG. 5*b* illustrates a second monochrome pattern resembling the letter "X" as defined by various "1's" and "0's" indicated in eight rows of one byte each.

Figure 6A:
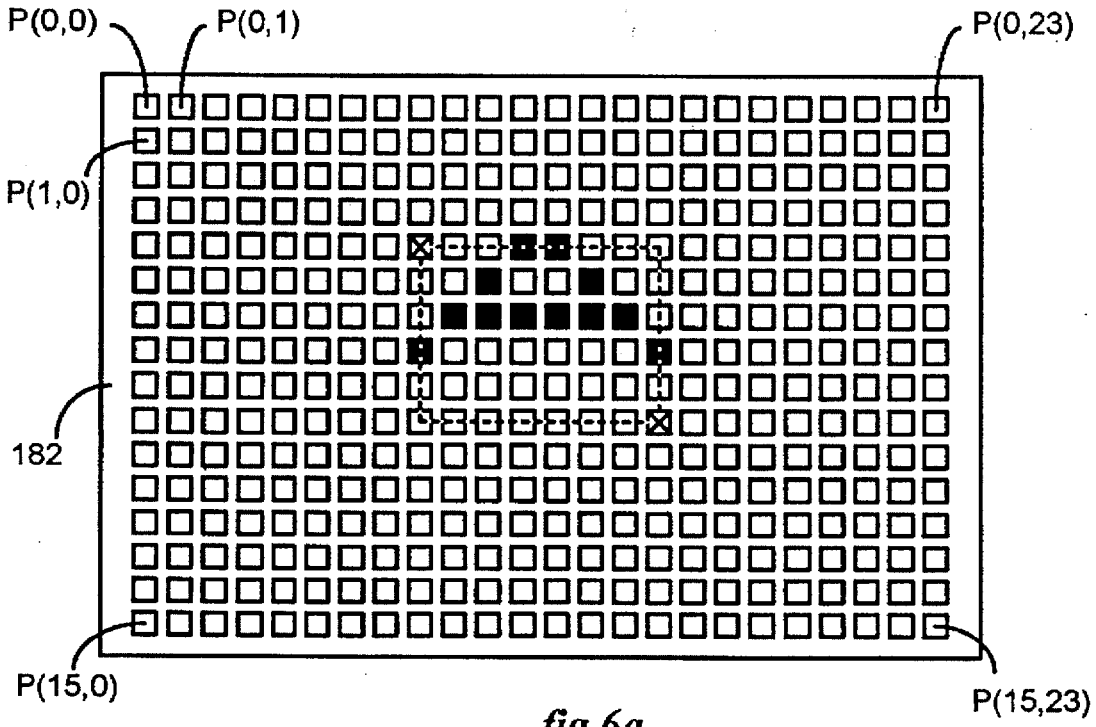
FIGS. 6*a* and 6*b* illustrates, as examples, the monochrome pattern of FIG. 5*a* displayed in two different locations of the portion of a screen display of a display device of FIG. 2.
Figure 6B:
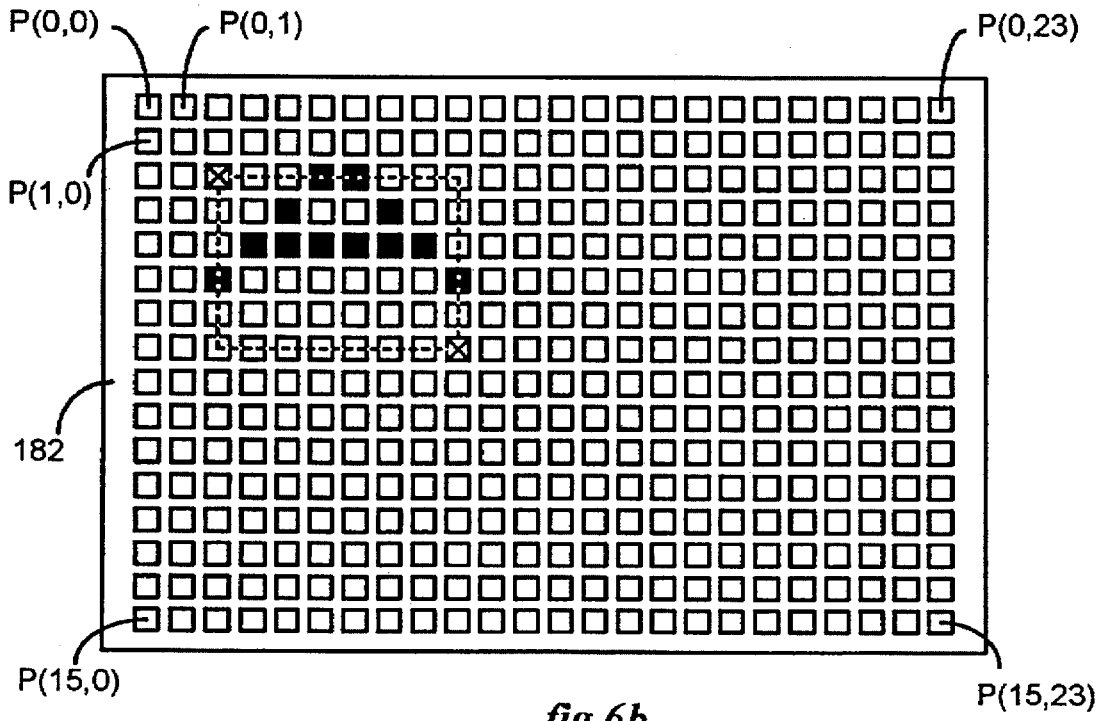

FIGS. 6*a* and 6*b* illustrates, as examples, the monochrome pattern of FIG. 5*a* displayed in two different locations of the screen display. In FIG. 6*a*, the monochrome pattern is superimposed in a destination memory area corresponding to the dotted rectangle on the display screen having a destination start address corresponding to pixel P(4,8); and in FIG. 6*b*, the monochrome pattern is superimposed in a destination memory area corresponding to the dotted rectangle on the display screen having a destination start address corresponding to pixel P(2,2).

Figure 7:
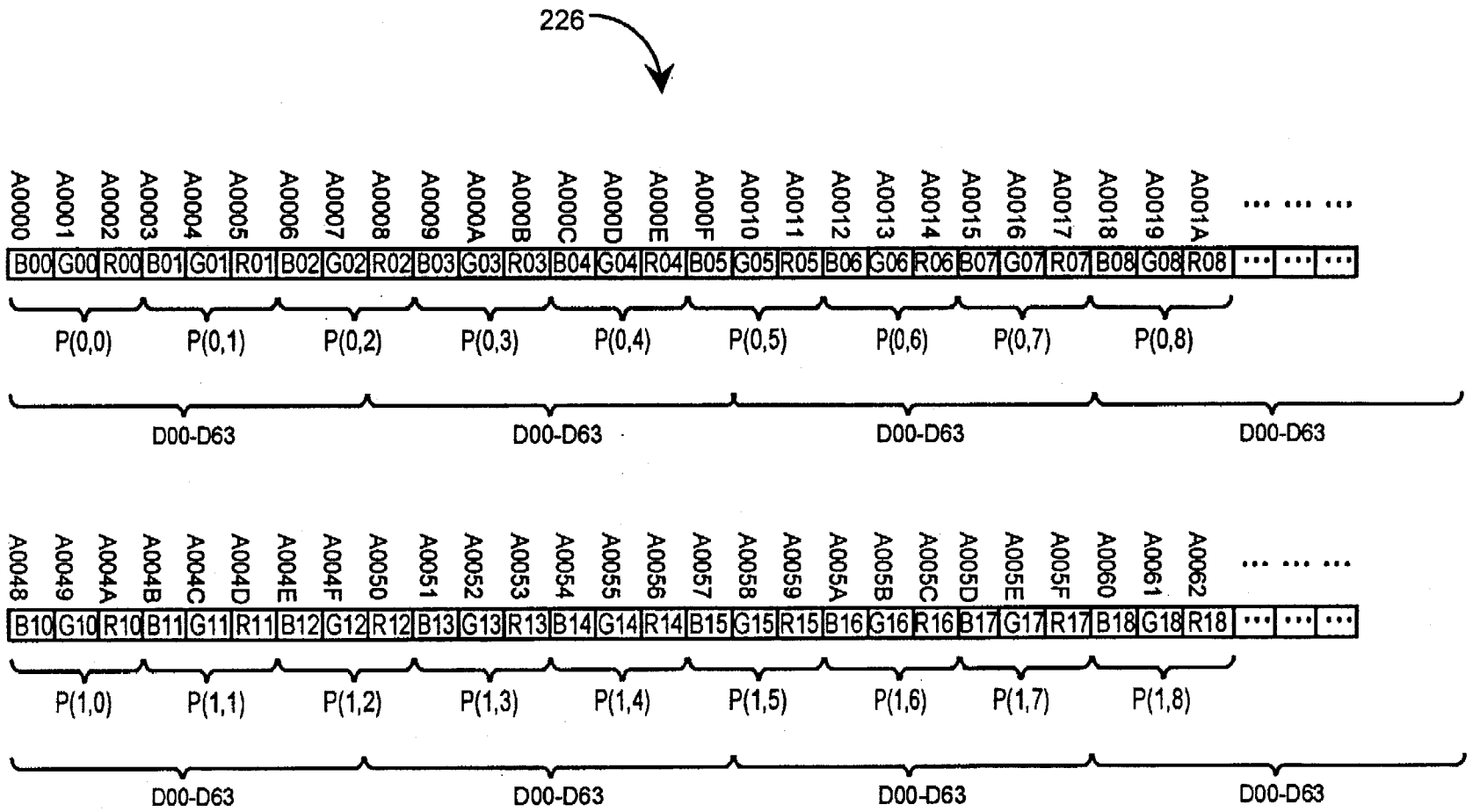
FIG. 7 illustrates, as an example, a portion of display memory including 888-RGB color-space format data corresponding to the first 9 pixels of each of the first two rows of a display unit screen.

FIG. 7 illustrates, as an example, a portion of display memory including 888-RGB color-space format data corresponding to the first 9 pixels of each of the first two rows of a display unit screen. Linear display addresses indicated in hexidecimal format (e.g., A0000) are associated with each byte of the 888-RGB color-space format data. For example, the first byte B00 corresponding to pixel P(0,0) is located at address A0000 and contains information relating to a blue color corresponding to that pixel, the second byte G00 corresponding to pixel P(0,0) is located at address A0001 and contains information relating to a green color corresponding to that pixel, and the third byte R00 corresponding to pixel P(0,0) is located at address A0002 and contains information relating to a red color corresponding to that pixel. The address for the first byte of each pixel is referred to herein as the starting address for that pixel. For examples, the starting addresses of the first eight pixels P(0,0) to P(0,7) are respectively A0000, A0003, A0006, A0009, A000C, A000F, A0012, and A0015.

When the data bus for the display memory 22 is 8-bytes wide, data for two and two-thirds pixels are included in each 8-byte wide read. For example, in a first 8-byte wide read, the data for pixels P(0,0) and P(0,1) are completely read, but only the first two bytes of data for pixel P(0,2) is read; in a second 8-byte wide read, the last byte of data for pixel P(0,2) is read, the data for pixels P(0,3) and P(0,4) are completely read, but only the first byte of data for pixel P(0,5) is read; and in a third 8-byte wide read, the last two bytes of data for pixel P(0,5) is read, and the data for pixels P(0,6) and P(0,7) are completely read. In subsequent 8-byte wide reads, the pattern repeats such that three 8-byte wide reads are required to completely read the data for sets of 8 consecutive linearly addressed pixels in the display memory 22.

Figure 8:
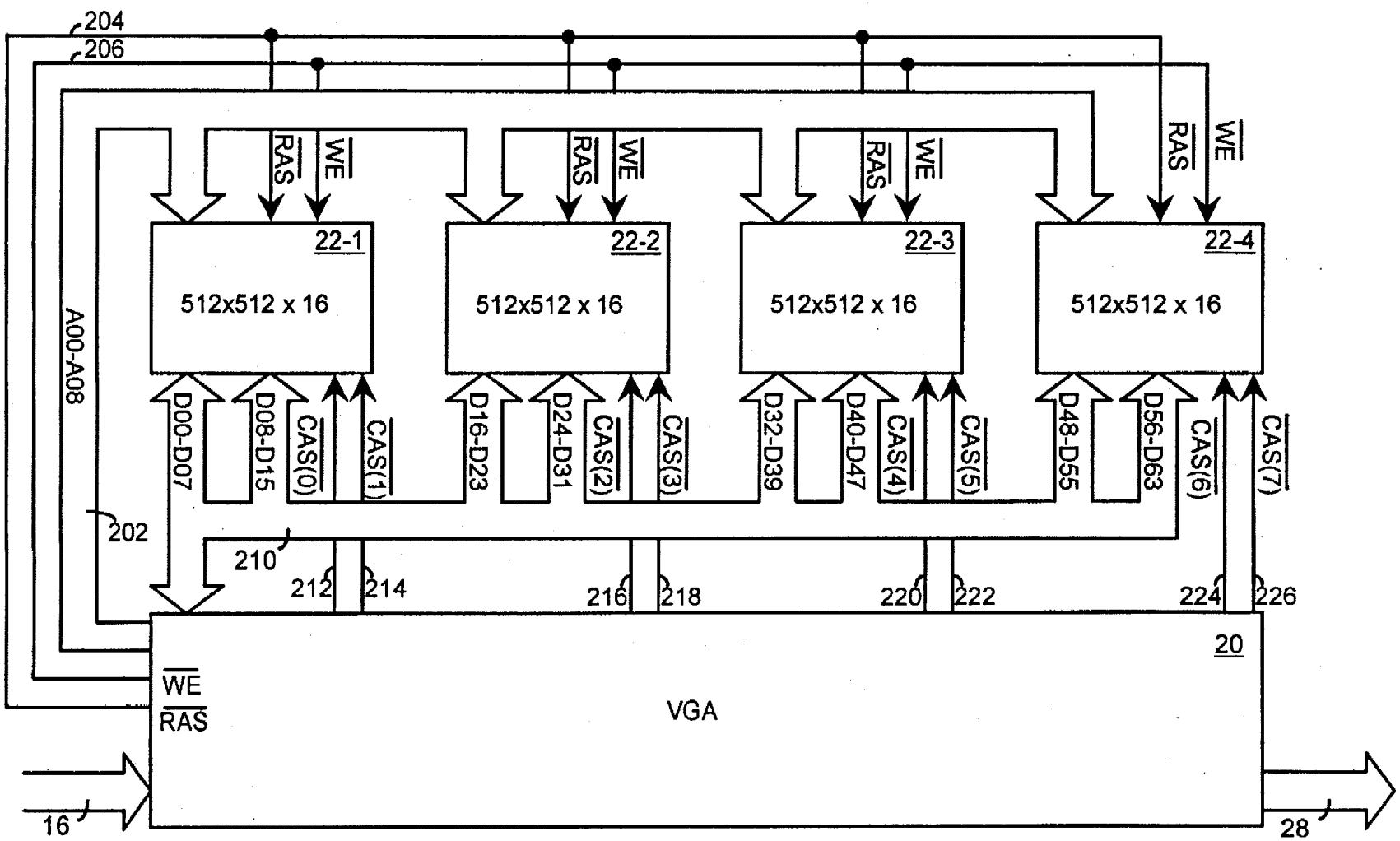
FIG. 8 illustrates, as an example, a block diagram detailing the connection of the display memory to the VGA of FIG. 1.

FIG. 8 illustrates, as an example, a block diagram indicating the connections between the display memory 22 and the VGA controller 20. The display memory 22 is formed in this example, by connecting four 512×512×16 DRAMs 22-1 to 22-4 to the VGA controller 20 as shown in the figure. As a result, data for a display screen of up to 512 rows and up to 1365 columns of pixels (512 times 2 and ⅔ pixels) may be stored in the display memory 22. This would be acceptable for a display resolution of 640×480, for example, but for larger resolution display screens, either larger DRAMs or additional 512×512×16 DRAMs may be required.

Each of the 512×512×16 DRAMs, 22-1 to 22-4, has sixteen connections to an internal data bus 210 for reading or writing two bytes of data via the internal data bus 210 (e.g., D000–D07 and D08–D15 for DRAM 22-1) and two connections to the VGA controller 20 for receiving two column address strobes (e.g., CAS(0)-bar and CAS(1)-bar for DRAM 22-1) from the VGA controller 20, which control the reading or writing of the DRAM's two bytes of data. Generally, one of the two column address strobes (e.g., CAS(0)-bar for DRAM 22-1) controls the memory's reading or writing of a lower byte of data (e.g., D00–D07 from the DRAM 22-1), and the other of the two column address strobes (e.g., CAS(1)-bar for DRAM 22-1) controls the reading or writing of an upper byte of data (e.g., D08–D15 from the DRAM 22-1). In particular, if the VGA controller 20 provides data on the internal data bus 210 and generates, for example, inactive HIGH signals on column address strobes CAS(0)-bar to CAS(2)-bar, and active LOW signals on column address strobes CAS(3)-bar to CAS(7)-bar, then the data on data lines D00–D07 and D08–D15 of the internal data bus 210 will not be stored in DRAM 22-1, the data on data lines D16–D23 of the internal data bus 210 will not be stored in DRAM 22-2, but the data on data lines D24–D31 will be stored in DRAM 22-2, the data on data lines D32–D39 and D40–D47 will be stored in DRAM 22-3, and the data on data lines D48–D55 and D56–D63 will be stored in DRAM 22-4.

Figure 9A:
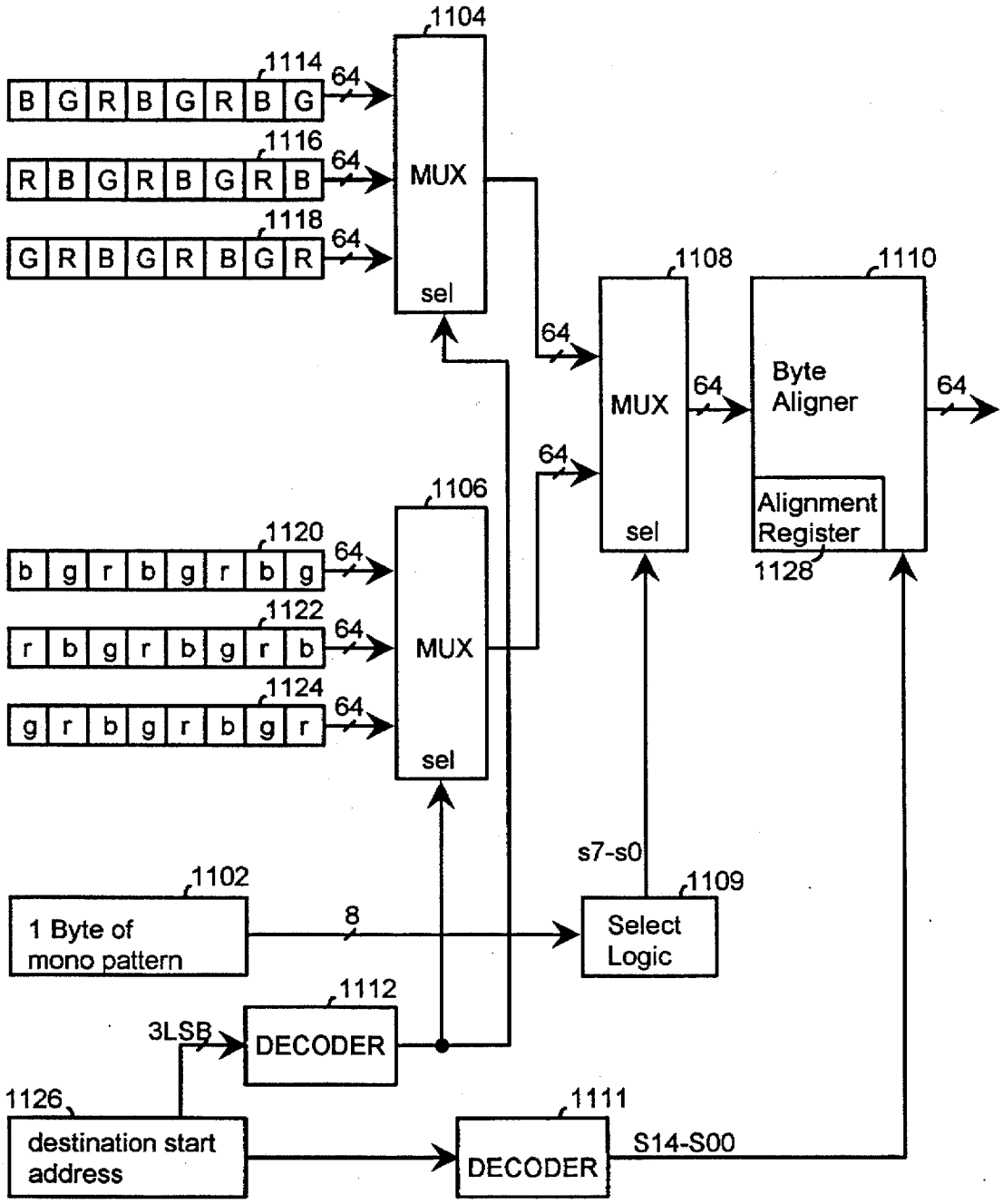
fig.9a prior art
FIGS. 9a–9c illustrate, as examples, block diagrams of certain portions of a prior art VGA.
Figure 9B:
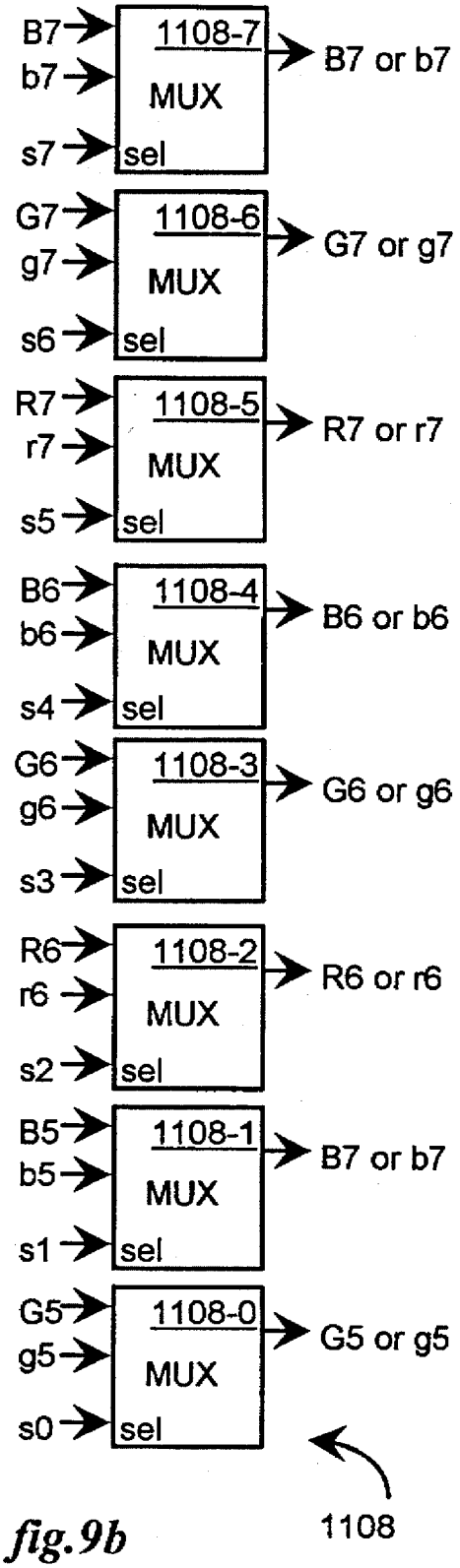
fig.9b prior art
Figure 9C:
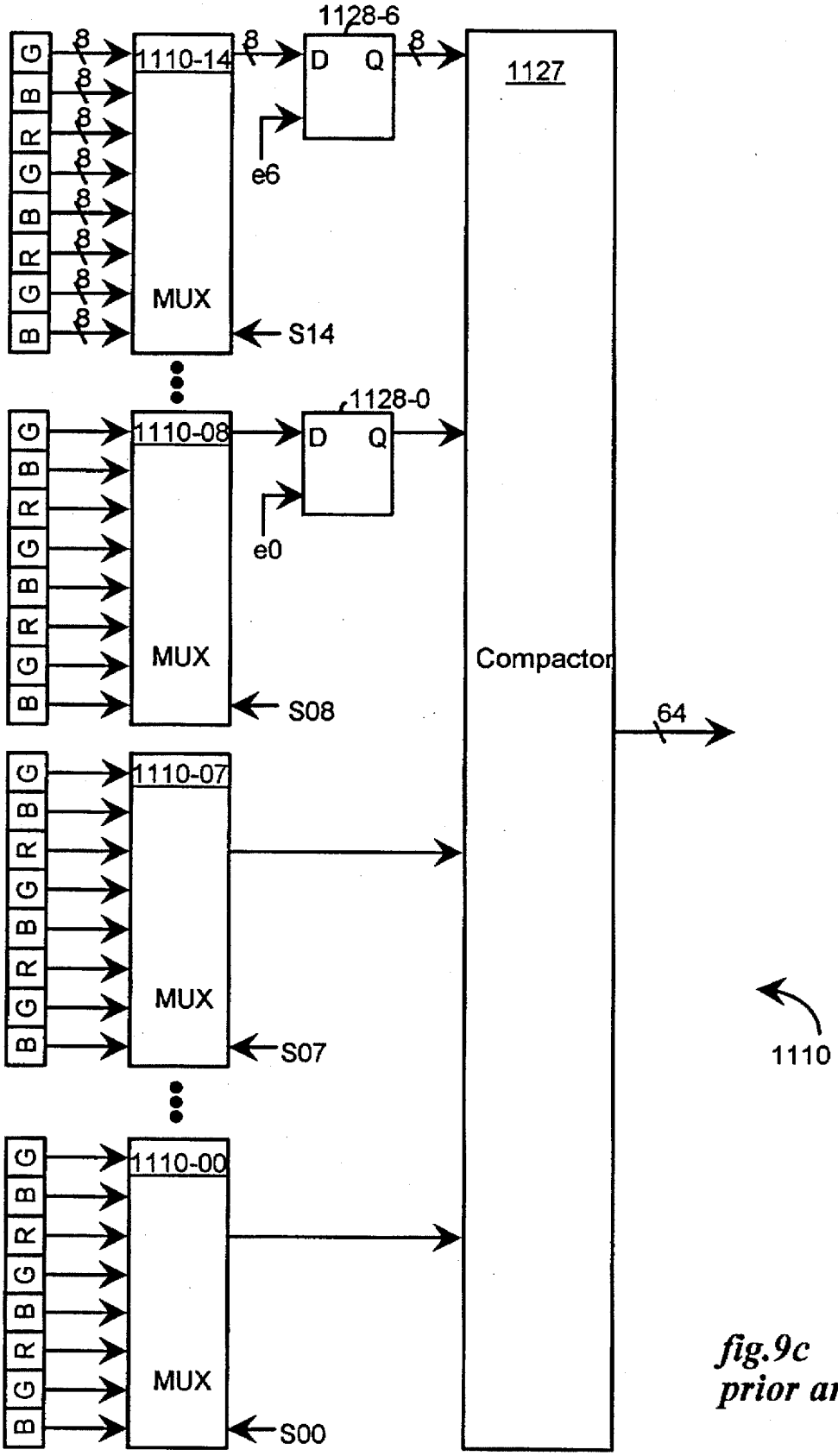
fig.9c prior art

FIGS. 9*a*–9*c* have been previously described as depicting certain portions of a prior art VGA. For additional details on prior art VGAs, see, e.g., the Technical Reference Manual for the Alpine™ VGA Family-CL-GD543X, Third Edition, March 1994, published by Cirrus Logic®, which is incorporated herein by this reference.

Figure 10:
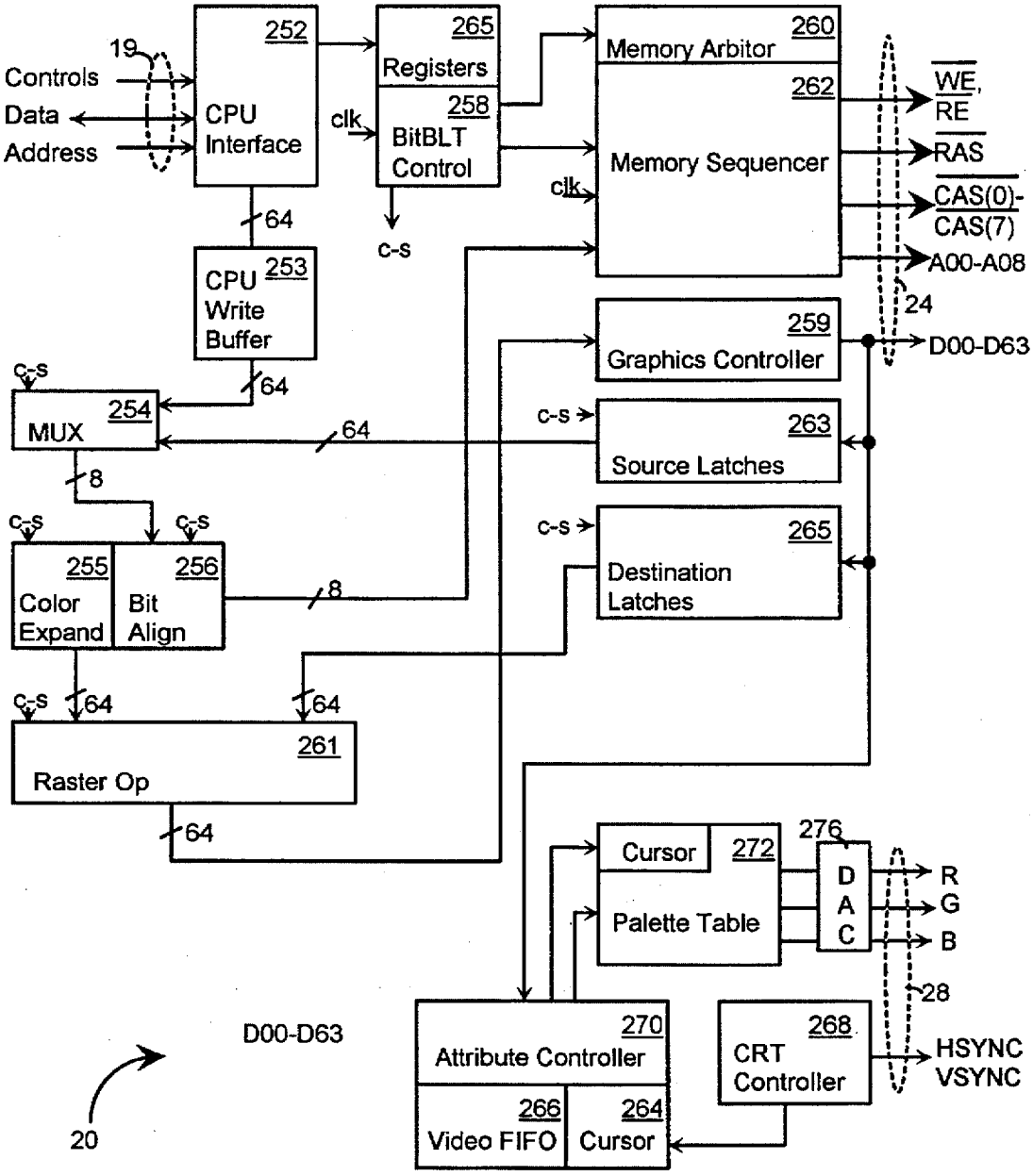
FIG. 10 illustrates, as an example, a block diagram of a VGA circuit utilizing aspects of the present invention.

FIG. 10 illustrates, as an example, a simplified functional block diagram of the VGA controller 20, utilizing aspects of the present invention. The VGA controller 20 preferably includes certain hardware required to implement host processor 12 updates to display memory 22, as well as to perform certain screen and DRAM refresh functions. As previously described in reference to FIG. 1, the VGA controller 20 interfaces with the host processor 12 through the bus interface 17. The bus interface 17 may be any one of a number of different types such that by properly adapting the VGA controller 20, the VGA controller 20 may communicate with the host processor 12 over a number of interfaces such as the ISA, VESA® VL-Bus™, or Intel®-PCI bus.

A CPU interface 252 receives via the bus interface 17, control signals, data, and addresses from the host processor 12. The CPU interface 252 stores certain data received from the host processor 12 via the subsystem bus 19 into registers 265 (including registers 224-1 to 224-15 of FIG. 11) in response to, for example, memory mapped I/O instructions from the host processor 12. Examples of such data include foreground and background colors in 888-RGB color-space format, and a destination start address corresponding to a BitBLT operation to be performed by the VGA controller 20. The CPU interface 252 also stores certain other data to be processed by the VGA controller 20 into a CPU write buffer 253. Examples of such other data include a monochrome pattern to be displayed on a display screen. Certain other functions and connections to and from the CPU interface 252 are omitted herein to avoid unnecessary complication in the description.

The VGA controller 20 includes a number of functional blocks for interfacing with the display memory 22. A memory sequencer 262 receives column address strobe values, CAV(0)-bar to CAV(7)-bar, from a bit align circuit 256, and transmits in response to certain timing and/or request signals from a BitBLT control 258, a row address strobe signal RAS-bar, a write enable signal WE-bar or a read enable signal RE-bar, column address strobe signals, CAS(0)-bar to CAS(7)-bar, and address signals A00-A08 to the display memory 22. A graphics controller 259 receives data from a raster operation circuit 261 (or the CPU write buffer 253) and transmits the data via data lines D00–D63 of the data bus 210 to the display memory 22 in response to the write enable signal WE-bar being activated. Source latches 263 receive data from the data lines D00–D63 of the data bus 210 from the display memory 22 in response to the read signal RE-bar being activated and a latch enable signal generated, for example, by the bitBLT control 258, and provide such data to a MUX 254. Destination latches 265 also receive data from the data lines D00–D63 of the data bus 210 from the display memory 22 in response to the read signal RE-bar being activated and another latch enable signal generated, for example, by the bitBLT control 258, and provide such data to the raster op circuit 261 (or back to the host processor 12 through the CPU interface 252).

The VGA controller 20 also includes a number of functional blocks for interfacing with the display unit 18. A CRT controller 268 generates horizontal synchronization HSYNC and vertical synchronization VSYNC signals to be provided to the display unit 18, and a digital-to-analog converter unit ("DAC") 276 generates the red, green and blue ("RGB") signals to be provided to the display unit 18 from information provided to it from a palette table 272 which in turn, generates such information from other information provided by an attribute controller 270, a video FIFO 266, and a cursor control 264. Since the construction and operation of these blocks are generally conventional, additional details on them are not provided herein.

Particular attention is now directed to certain functional blocks in the VGA controller 20 which perform the BitBLT operation function. In addition to generating certain timing signals for other functional blocks in the VGA controller 20, the BitBLT control 258 also generates certain control signals ("c–s") for other functional blocks in the VGA controller 20, when a BitBLT operation is to be performed. In order to simplify the figure, individual ones of the control signals are not illustrated. It is to be understood, however, that certain ones of these signals are provided to various ones of the VGA controller 20 functional blocks, and not necessarily, all such signals, to each of the functional blocks.

The CPU write buffer 253 and the source latches 263 are connected to a MUX 254. If monochrome pattern data is being provided by the host processor 12 from the system memory 14, the MUX 254 passes in response to a byte select control signal generated by the BitBLT control 258, one byte from the CPU write buffer 253 at a time to a color expand circuit 255 and a bit align circuit 256. On the other hand, if monochrome pattern data is being provided from the display memory 22, the MUX 254 passes in response to the byte select control signal generated by the BitBLT control 258, one byte from the source latches 263 at a time to the color expand circuit 255 and the bit align circuit 256. A source control signal to the MUX 254 indicates whether the monochrome pattern data is being provided by the host processor 12 from the system memory 14, or from the display memory 22.

The color expand circuit 255 in response to control and timing signals c–s generated by the BitBLT control 258, generates an 8 byte RGB-color pattern of foreground colors, which matches a RGB-color pattern of the data stored in the destination latches 265. The bit align circuit 256 in response to control and timing signals c–s generated by the BitBLT control 258, generates the column address strobe values, CAV(0)-bar to CAV(7)-bar, from which the memory sequencer generates the column address strobe signals, CAS(0)-bar to CAS(7), which control the writing of data to the display memory 22. The raster operation circuit 261 logically combines the 8-byte RGB-color pattern of foreground colors from the color expand circuit 255 and the data stored in the destination latches 265, and communicates the result to the graphics controller 259.

Figure 11:
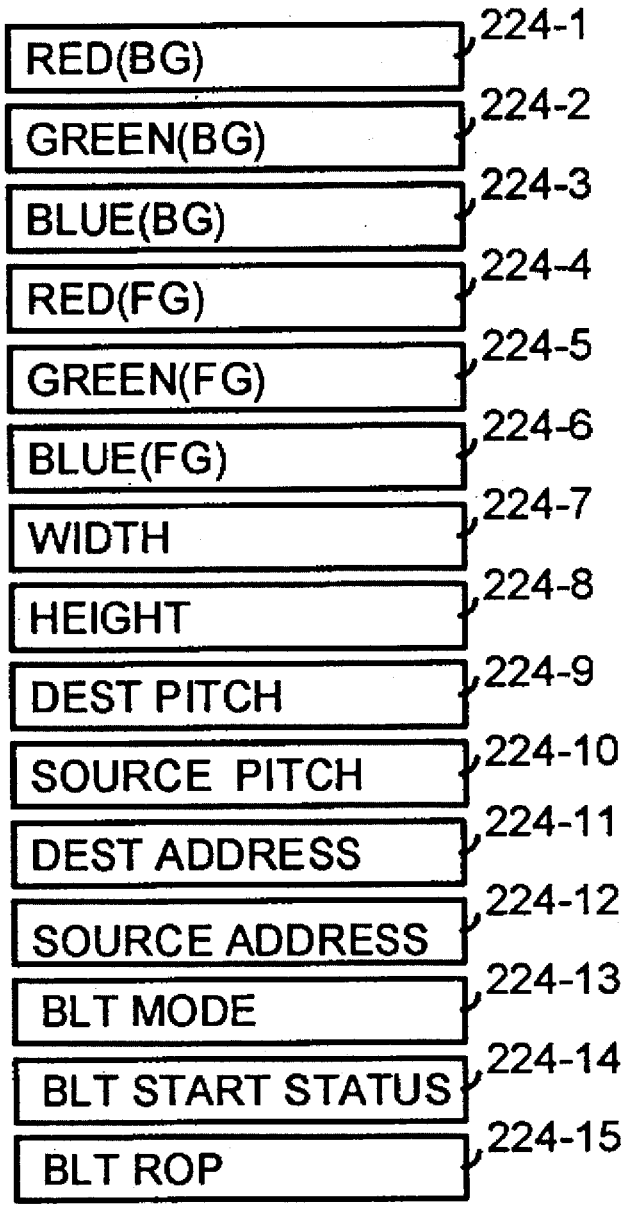
FIG. 11 illustrates, as examples, various registers stored, for example, in a register area of the VGA of FIG. 10.

FIG. 11 illustrates, as examples, various registers 224-1 to 224-16 useful for the BitBLT operation, which are included in the registers 265 of the VGA controller 20. The host processor 12 writes data into these registers, for example, using conventional memory mapped I/O techniques, so that these data are made available to the VGA controller 20 for subsequent processing performed generally without host processor 12 intervention. Registers 224-1 to 224-3 contain the foreground 888-RGB color-space format data, and registers 224-4 to 224-6 contain the background 888-RGB color-space format data. Registers 224-7 and 224-8 respectively contain the width "W" and height "H" of a block of pixels indicated by a rectangle defined on a display screen by a pointing device 26 in a manner described in reference to FIG. 2. In particular, the register 224-7 contains the width "W" of the rectangle in bytes, wherein three bytes are required for indicating the color of each pixel, and the register 224-8 contains the height "H" of the rectangle in scan lines. A register 224-9 contains the destination pitch from which the starting address for subsequent rows of pixels can be determined. A register 224-11 contains the destination start address ("DSA") for a BitBLT operation. A register 224-13 contains data indicative of whether the source memory area (i.e., the monochrome pattern to be operated upon in the BitBLT operation) is in the system memory 14 or the display memory 22. A register 224-14 contains data indicative of whether or not the VGA controller 20 is busy performing a BitBLT operation. A register 224-15 contains the raster operation to be performed in the BitBLT operation.

Figure 12:
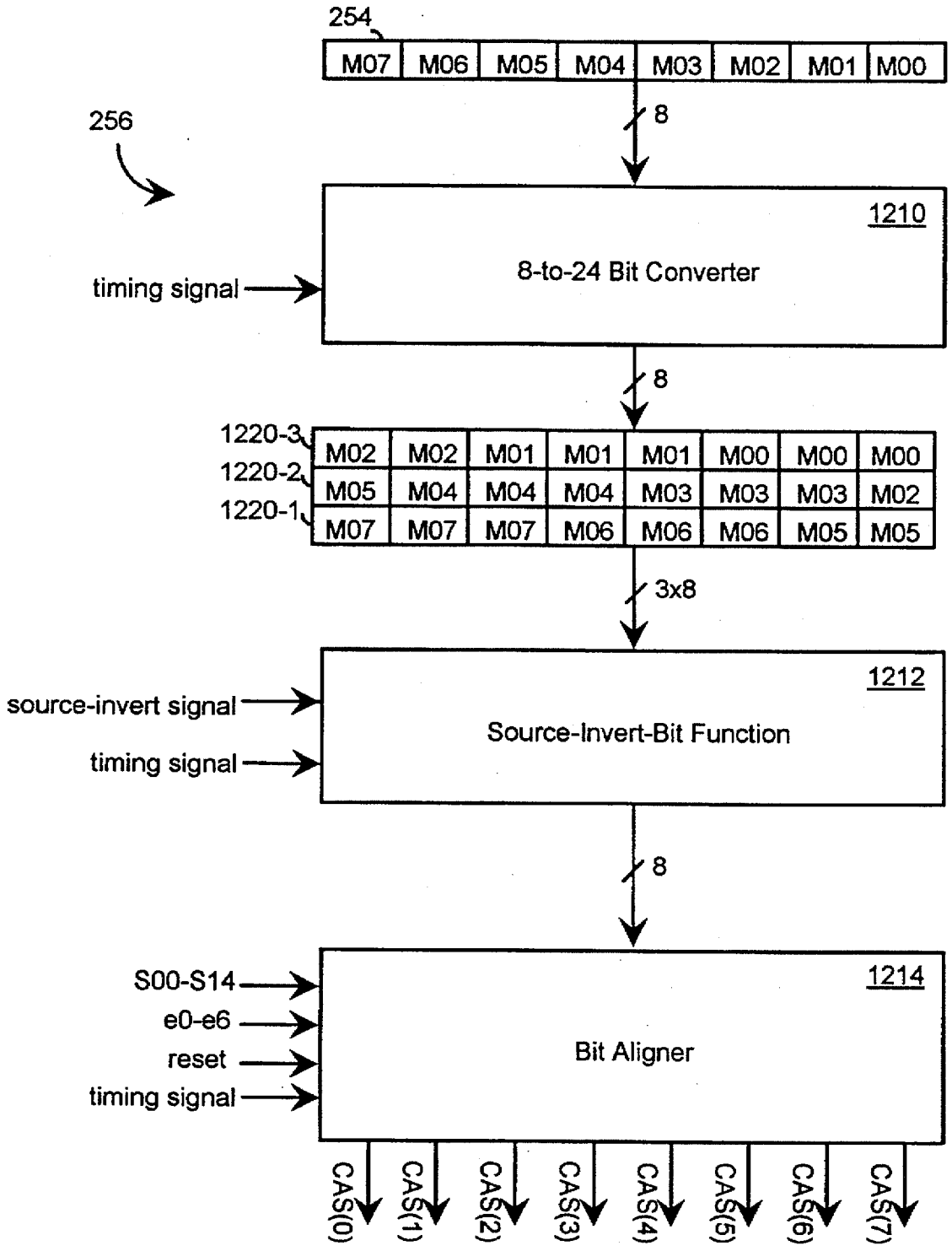
FIG. 12 illustrates, as an example, a block diagram of a bit align circuit of the VGA of FIG. 10, utilizing aspects of the present invention.

FIG. 12 illustrates, as an example, a block diagram of the bit align circuit 256. An 8-to-24 bit converter 1210 receives 8-bits of a monochrome pattern from the MUX 254, and expands the 8-bits into 24-bits by replicating each bit three times. In one embodiment, the expanded 24-bits is stored 8-bits at a time into three 8-bit wide registers, 1220-1 to 1220-3. A source-invert-bit function unit 1212 receives the contents of each of the three 8-bit wide registers, 1220-1 to 12203, and passes the contents of one of them to a bit aligner 1214 in response to the output of a 3-cycle counter 1216. In another embodiment (not shown), however, the three registers, 1220-1 to 1220-3, are replaced through hardwired logic (not shown) passing 8-bits of selected data to the source-invert-bit function unit 1212 in response to control signals from the BitBLT control 258 or a 3-cycle counter such as 1215. The source-invert-bit function unit 1212 inverts the 8-bits being passed if a source-invert signal is activated HIGH. The bit aligner 1214 receives the passed 8-bits from the source-invert-bit function unit 1212, and generates a series of column address values, CAV(0)-bar to CAV(7)-bar, in response to certain control signals c–s from the BitBLT control 258 as more fully described in reference to FIGS. 14 and 15.

Figure 13:
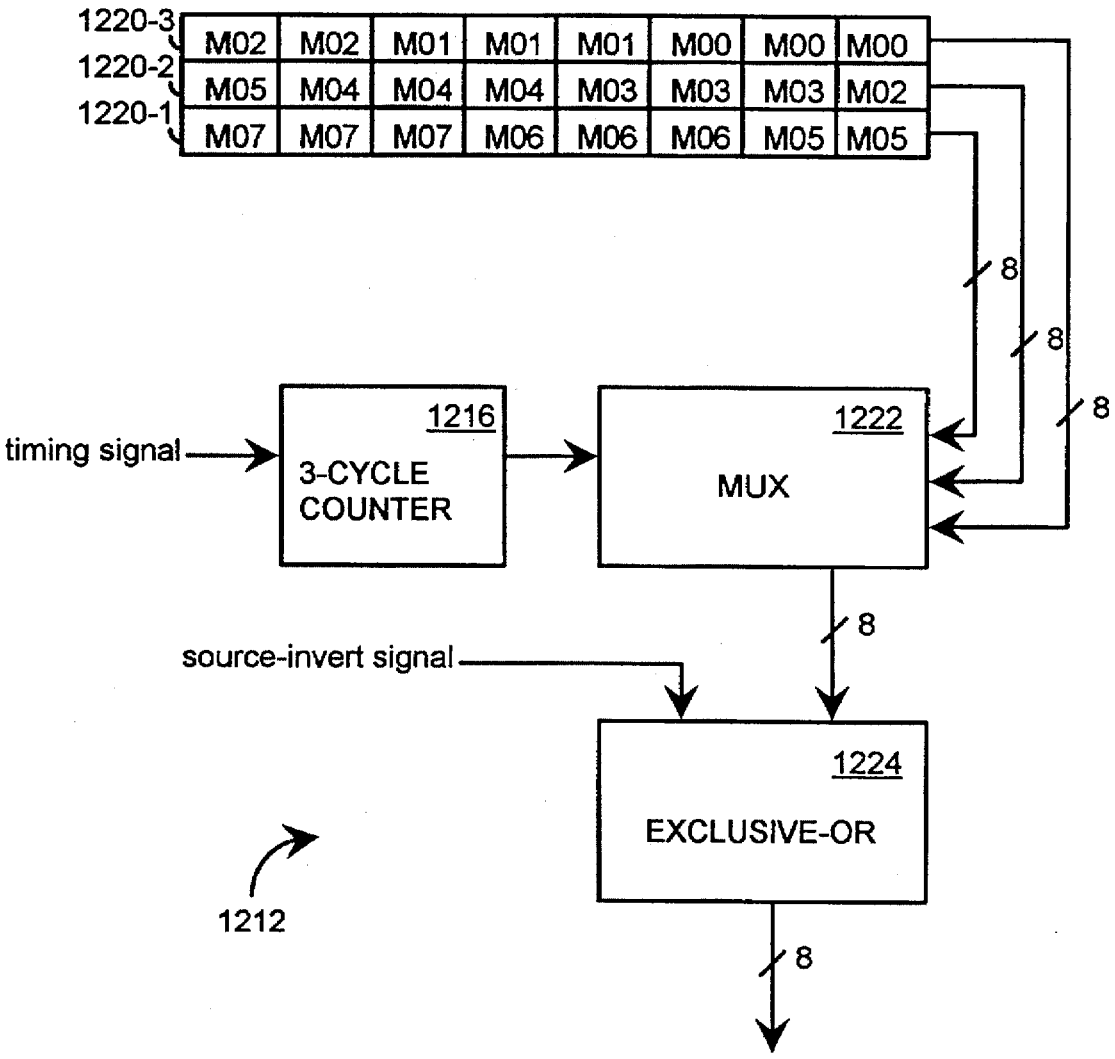
FIG. 13 illustrates, as an example, a source-invert-bit-function circuit of the bit align circuit of FIG. 12.

FIG. 13 illustrates, as an example, a block diagram of the source-invert-bit function unit 1212. To simplify the description, it is assumed that the expanded 24-bits is stored 8-bits at a time into three 8-bit wide registers, 1220-1 to 1220-3. As described in reference to FIG. 12, however, it is to be understood in the following description that the three registers, 1220-1 to 1220-3, could be replaced through hardwired logic passing 8-bits of selected data to the source-invert-bit function unit 1212 in response to control signals from the BitBLT control 258 or a 3-cycle counter such as 1215.

A MUX 1222 receives the 8-bits from each of the registers 1220-1 to 1220-3, and passes the 8-bits from one of the three registers to an exclusive-OR unit 1224 in response to a select signal received from the 3-cycle counter 1216. For example, when the state of the 3-cycle counter 1216 is 0, the MUX 1222 passes the 8-bits received from the register 1220-1 to the exclusive-OR unit 1224, when the state of the 3-cycle counter 1216 is then incremented to a 1, the MUX 1222 passes the 8-bits received from the register 1220-2 to the exclusive-OR unit 1224, and when the state of the 3-cycle counter 1216 is then incremented to a 2, the MUX 1222 passes the 8-bits received from the register 1220-3 to the exclusive-OR unit 1224. Subsequently, a new byte of the monochrome pattern is received from the MUX 254 by the 8-to-24 bit converter 1210, the registers 1220-1 to 1220-3 are filled with new expanded data, and the 3-cycle counter 1216 resets to 0 so that the MUX 1222 can sequentially pass in the same described fashion, the new contents of the registers 1220-1 to 1220-3 to the exclusive-OR unit 1224.

In addition to receiving the contents of one of the registers 1220-1 to 1220-3, the exclusive-OR unit 1224 also receives a source-invert signal from the BitBLT control unit 258. Consistent with the logical operation of an exclusive-OR, when the source-invert signal is LOW, the received contents of one of the registers 1220-1 to 1220-3 is passed "as is" to the bit aligner 1214, and when the source-invert signal is HIGH, the received contents of one of the registers 1220-1 to 1220-3 is passed "inverted" to the bit aligner 1214. For example, if the received 8 bits are 00110011 and the source-invert signal is LOW, then the 8 bits passed to the bit aligner 1214 are 00110011. On the other hand, if the received 8 bits are 00110011 and the source-invert signal is HIGH, then the 8 bits passed to the bit aligner 1214 are 11001100. Use of the source-invert signal allows the BitBLT engine to write foreground and background color information into the display memory 22 in two separate operations rather than writing both foreground and background color information into the display memory 22 in the same operation. This feature is particularly advantageous when the background color is preferably transparent, as is often the case when a monochrome pattern is to be superimposed on a display screen. Thus, in those cases, this feature significantly speeds up writing to the display memory 22.

Figure 14:
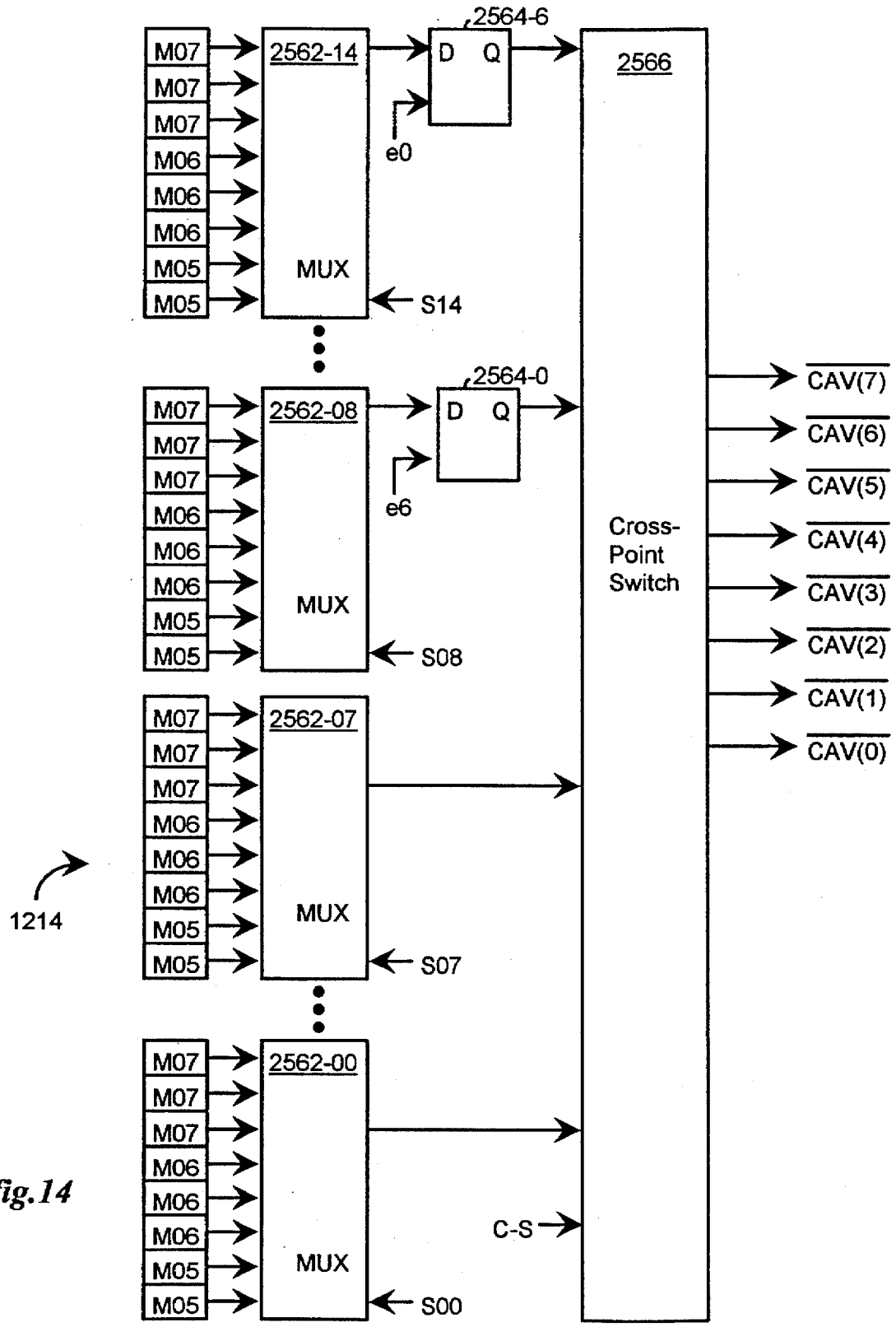
FIG. 14 illustrates, as an example, a bit aligner circuit of the bit align circuit of FIG. 12.

FIG. 14 illustrates, as an example, certain functional blocks of the bit aligner 1214. A plurality of MUXs, 2562-00 to 2562-14, each receive a first 8 bits of monochrome pattern data from the source-invert-bit-function circuit 1212, and passes in response to its corresponding select signals, one or none of the 8 bits received. An alignment register 2564 included in the bit aligner 1214 comprises a plurality of flip-flops or latches, 2564-0 to 2564-6, each receiving a bit of data respectively from corresponding, MUXs 2562-08 to 2562-14. A cross-point switch 2566 receives the fifteen bits of data, one each from MUXs 2562-00 to 2562-07 and one each from flip-flops 2564-0 to 2564-6, and generates the eight column address strobe values, CAV(0)-bar to CAV(7)-bar, in response to control signals c–s. Select signals S00–S14 controlling the MUXS, 2562-00 to 2564-14, enable signals e0–e6 controlling the flip-flops, 2564-0 to 2564-6, and control signals c–s controlling the cross-point switch 2566 are generated by the BitBLT control 258 by employing, for example, the decoder or look-up table function illustrated in Table II (except shifting a number of bits to the right instead of a number of bytes).

For example, if the DSA is A0003, the BitBLT control 258 generates select signals S00–S14 and enable signals e0–e6 such that the MUXs, 2562-03 to 2562-10, and the flip-flops, 2564-0 to 2564-3, pass the eight bits received from the source-invert-bit function 1212, and the remaining MUXs, 2562-0 to 2562-2 and 2562-11 to 2562-14, and the remaining flip-flops, 2564-4 to 2564-6, either pass none of the bits received from the source-invert-bit function 1212 or pass a bit which is subsequently ignored by the cross-point switch 2566. In particular, if the DSA is A0003, the MUX 2562-3 passes the first bit received from the source-invert-bit function 1212, the MUX 2562-4 passes the second bit received from the source-invert-bit function 1212, the MUX 2562-5 passes the third bit received from the source-invert-bit function 1212, the MUX 2562-6 passes the fourth bit received from the source-invert-bit function 1212, the MUX 2562-7 passes the fifth bit received from the source-invert-bit function 1212, the MUX 2562-8 passes the sixth bit received from the source-invert-bit function 1212, the MUX 2562-9 passes the seventh bit received from the source-invert-bit function 1212, and the MUX 2562-10 passes the eighth bit received from the source-invert-bit function 1212. In addition, the flip-flop 2564-0 stores the state of the bit passed by the MUX 2562-08, the flip-flop 2564-1 stores the state of the bit passed by the MUX 2562-9, and the flip-flop 2564-2 stores the state of the bit passed by the MUX 2562-10. Timing of the enable signals e0–e6 are such that the bits of data stored in the flip-flops, 2564-0 to 2564-2, are provided to the cross-point switch 2566 while the MUXs, 2562-00 to 2562-14, are passing a subsequent eight bits received from the source-invert-bit function 1212.

The cross-point switch 2566 may be conventionally constructed. In particular, the cross-point switch 2566 connects through internal switching logic controlled by control signals c–s generated by the BitBLT control 258, eight of its fifteen inputs to its eight outputs. For example, the output the MUX 2562-00 may be selectively connected to any one of the eight outputs of the cross-point switch 2566, the output of the MUX 2562-01 may be selectively connected to any one but the first output of the cross-point switch 2566, the output of the MUX 2562-02 may be selectively connected to any one but the first two outputs of the cross-point switch 2566, and so on, to the output of the MUX 2562-07 which may be selectively connected to anyone but the first seven outputs of the cross-point switch 2566 (i.e., selectively connected to only the last output of the cross-point switch 2566). In addition, the output of the flip-flop 2564-0 may be switchably connected to the first output of the cross-point switch 2566, the output of the flip-flop 2564-1 may be switchably connected to the second output of the cross-point switch 2566, and so on, to the output of the flip-flop 2564-6 which may be switchably connected to the seventh output of the cross-point switch 2566. The eight outputs of the cross-point switch 2566 respectively provide the column address strobe values, CAV(0)-bar to CAV(7)-bar.

Figure 15:
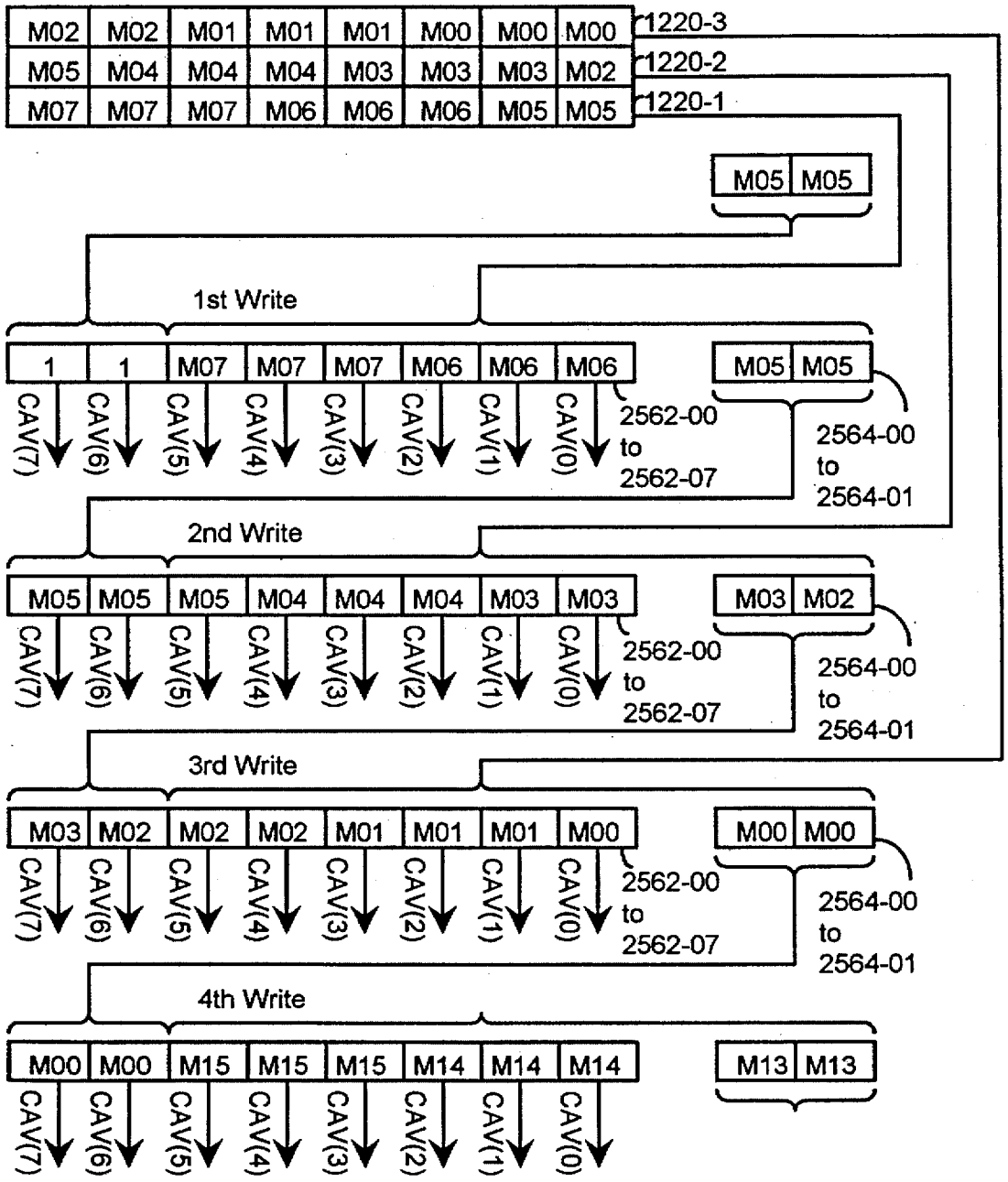
FIG. 15 illustrates, as an example, the contents of certain registers associated with the bit align circuit of FIG. 12, during four successive writes to the display memory.

FIG. 15 is a data flow diagram useful for understanding the operation of the bit aligner 1214. In the example, it is assumed that the destination start address is A0012 as depicted in FIG. 7. Preferably, before initially writing to the destination memory area in the display memory 22 (i.e., just before writing to the first addressable area including the destination start address in the display memory 22), the flip-flops, 2564-00 to 2564-06, are each set to "1" by a reset signal generated by the BitBLT control 258. In a first data cycle (corresponding to time period t0–t2 in FIG. 17, for example), the BitBLT control 258 reads the destination start address from the destination address register 224-11, and generates control signals, S00–S14 and e0–e6, indicating how many bits to the right the 8 bits received from the MUX 254 are to be shifted (i.e., from which of the MUXs, 2562-00 to 2562-07, the first bit of the 8 bits received from the MUX 254 passes). Assuming that the destination start address is A0012, then the BitBLT control 258 generates control signals S00–S14 and e0–e6, causing the first 8 bits received from the registers, 1220-1 to 1220-3, through the source-invert-bit function 1212, to be effectively shifted two bits to the right. In particular, the BitBLT control 258 performs a decoder function by, for example, first dividing the destination start address contained in register 224-11 by 24 (base 10), then looking up the number of bits to be shifted to the right from a look-up table such as illustrated in Table II (except shifting a number of bits to the right instead of a number of bytes), then decoding the number of bits to be shifted to the right into the appropriate control signals, S00–S14 and e0–e6.

As the 8 bits received from the registers, 1220-1 to 1220-3, through the source-invert-bit function 1212, are thus effectively shifted to the right, the shifted out bits are provided to corresponding D-inputs of the flip-flops, 2564-0 to 2564-6. For example, if the DSA is A0012, the BitBLT control 258 generates MUX select control signals, S00–S14, such that MUXS 2562-02 through 2562-09, pass the 8 bits received from the MUX 254. Data provided to the D-inputs of the flip-flops, 2564-0 and 2564-1, are not latched into the flip-flops, however, until the flip-flops are enabled by their corresponding enable control signals, e0 and e1. Timing of the enable control signals, e0–e6, generated by the BitBLT control 258 are such that the cross-point switch 2566 passes the initial contents (i.e., "1") of flip-flops, 2564-0 and 2564-1, while passing the passed bits from MUXs 2562-02 through 2562-07, to generate the column address strobe values, CAV(0)-bar to CAV(7)-bar, as indicated in FIG. 15 by generating the higher column address strobe values, CAV(7) and CAV(6), from the contents of flip-flops, 2564-0 and 2564-1, and the lower column address strobe values, CAV(5) to CAV(0), from the bits respectively passed by MUXs 2562-02 through 2562-07.

Figure 17:
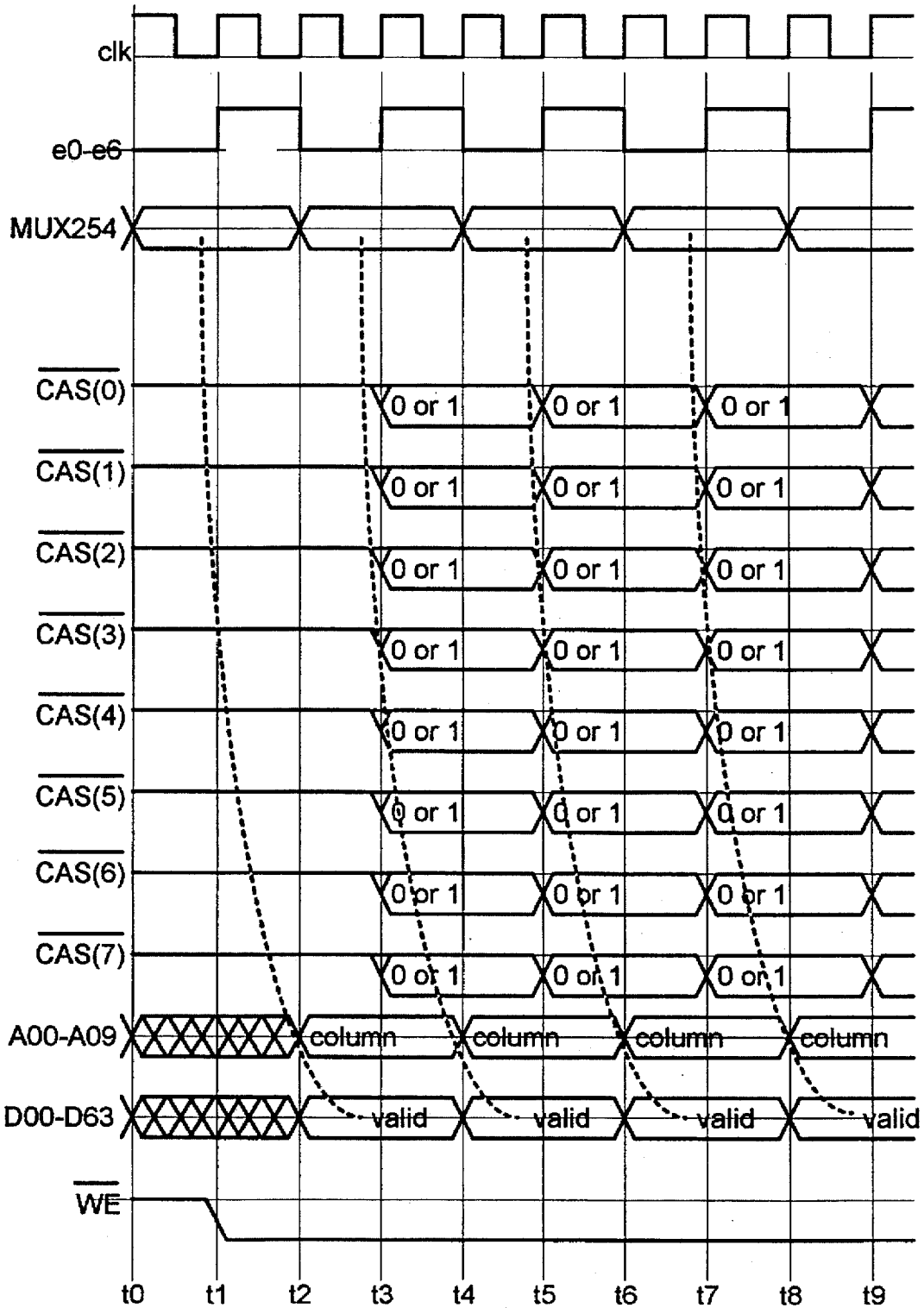
FIG. 17 illustrates, as examples, timing diagrams for certain signals related to the VGA of FIG. 10, utilizing aspects of the present invention.

Prior to a second data cycle (corresponding to time t2–t4 in FIG. 17, for example), the BitBLT control 258 activates appropriate ones of the enable control signals, e0–e6, such that data provided at the D-inputs of corresponding flip-flops, 2564-0 to 2564-6, are latched into the enabled flip-flops (at time t1 in FIG. 17, for example). For example, if the DSA is A0012, the BitBLT control 258 generates enable control signals such that flip-flops, 2564-0 and 2564-1, store the data (i.e., the state of the bit) provided at their respective D-inputs. This is the data passed through by MUXs, 2562-8 and 2562-9, as previously described in reference to the first write cycle. Still prior to the second data cycle, but after the BitBLT control 258 has generated the enable control signals causing flip-flops, 2564-0 and 2564-1, to store the previous data cycle's data, the BitBLT control 258 causes the source-invert-bit function 1212 to process the next 8 bits stored in the registers, 1220-1 to 1220-3, and provide the processed 8 bits to the bit aligner 1214.

In a 2nd data cycle (corresponding to time period t2–t4 in FIG. 17, for example), the next 8 bits received from the source-invert-bit function unit 1212 are processed by the bit aligner 1214. In the second and subsequent data cycles, however, the BitBLT control 258 does not have to re-decode the destination start address as long as the destination start address stored in register 224-11 remains the same. Consequently, the control signals, S00–S14 and e0–e6, for the first write cycle are replicated by the BitBLT control 258 for subsequent write cycles processing the same BitBLT operation. The BitBLT control 258 does, however, check appropriate registers in the registers 265 to determine when the BitBLT operation has ended. The second series of column address strobe values, CAV(0)-bar to CAV(7)-bar, are then generated such that the higher column address strobe values, CAV(7) and CAV(6), are generated from the contents (storing the previous data cycle's bits) of flip-flops, 2564-0 and 2564-1, and the lower column address strobe values, CAV(5) to CAV(0), are generated from the bits respectively passed by MUXs 2562-02 through 2562-07, during the current data cycle.

During third and subsequent data cycles, the process described in reference to the second data cycle is repeated. Before the 4th data cycle, however, 8 more bits of the monochrome pattern are provided to the bit align circuit 256 by the MUX 254 in response to control signals from the BitBLT control 258. The 8-to-24 bit converter 1210 then expands these 8 bits into 24 bits as previously described, and stores the expanded bits into registers 1220-1 to 1220-3. The source-invert-bit function unit 1212 then passes the contents of one of the registers 1220-1 to 1220-3, as determined by the 3-cycle counter 1216, to the bit aligner 1214. The 8 bits received from the source-invert-bit function unit 1212 are then processed in a similar fashion as described in reference to the first three data cycles.

Figure 16:
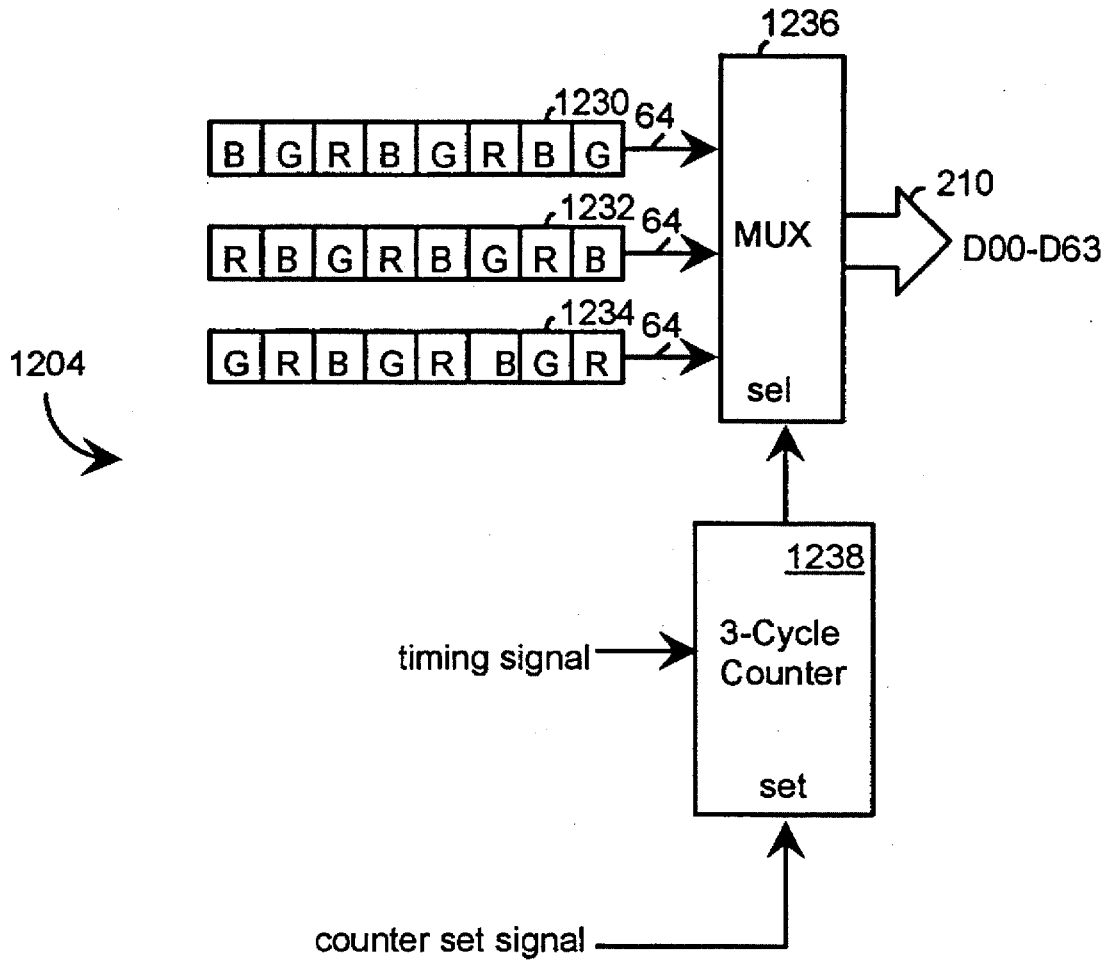
FIG. 16 illustrates, as an example, a block diagram of the color expand circuit of the VGA of FIG. 10, utilizing aspects of the present invention.

FIG. 16 illustrates, as an example, a block diagram of the color expand circuit 255. In one embodiment, three foreground color registers 1230, 1232 and 1234 are filled in the same manner as described in reference to registers 1114, 1116 and 1118 in FIG. 9*a*. In particular, the three foreground color registers 1230, 1232 and 1234 represent each of the three possible sequences of red, blue, and green bytes in an 8-byte wide read from the display memory 22. A MUX 1236 receives the 8-bytes stored in each of the registers 1230, 1232 and 1234 and places one of the 8-bytes from one of the registers 1230, 1232 and 1234 on the internal data bus 210 in response to select signals received at its select ("sel") inputs from a 3-cycle counter 1238. For example, if the MUX 1236 receives the select signal pair "00" from the 3-cycle counter 1238, it passes the 8-bytes from register 1230 onto the internal data bus 210; if the MUX 1236 receives the select signal pair "01" from the 3-cycle counter 1238, it passes the 8-bytes from register 1232 onto the internal data bus 210; and if the MUX 1236 receives the select signal pair "10" from the 3-cycle counter 1238, it passes the 8-bytes from register 1234 onto the internal data bus 210.

The 3-cycle counter 1238 is set to an initial state by the BitBLT control 258. The BitBLT control 258 sets the 3-cycle counter 1238 to its initial state in response the 3LSBs of the destination start address using a table look-up such as as described in reference to Table I. In particular, if the 3LSBs of the DSA are 000, 011, or 110, then the BitBLT control 258 sets the initial state of the 3-cycle counter 1238 to 00; if the 3LSBs of the DSA are 001, 100, or 111, then the BitBLT control 258 sets the initial state of the 3-cycle counter 1238 to 01; and if the 3LSBs of the DSA are 010 or 101, then the BitBLT control 258 sets the initial state of the 3-cycle counter 1238 to 10. The 3-cycle counter 1238 is then incremented for each new data cycle by timing signals received from the BitBLT control 258.

In another embodiment (not shown), the three 8-byte wide registers 1230, 1232, and 1234 may be replaced with the smaller, three byte-wide foreground registers 224-4, 224-5, and 224-6. Each of the three byte-wide foreground registers 224-4, 224-5, and 224-6, may then be provided as selectable inputs to 8 MUXs (not shown), wherein each MUX provides one byte of the 8-bytes of 888-RGB color-space formatted data provided to the raster op circuit 261. Appropriate select control signals may then be generated by the BitBLT control 258 and provided to the 8 MUXs (not shown) such that the appropriate BGR pattern corresponding to the next operable 8-bytes of 888-RGB color-space formatted data stored in the destination latches 265 is provided.

FIG. 17 illustrates, as examples, timing diagrams for certain signals associated with a BitBLT operation controlled by the VGA controller 20. Prior to the time t0, the host processor 12 has stored appropriate data into the registers, 224-1 to 224-15, to perform a desired BitBLT operation, and provided 8-bytes of a monochrome pattern to be operated upon during the BitBLT operation to the CPU write buffer 253. The BitBLT control 258 in conjunction with the memory sequencer 262 then performs a number of preliminary functions. The BitBLT control 258 reads the destination start address from the register 224-11, and translates it into appropriate row and column addresses for accessing the display memory 22. The memory sequencer 262 in response to control signals received from the BitBLT control 258, provides the row address A00–A09 corresponding to the destination start address on the internal address bus 202, and strobes the provided row address into each of the row address buffers of the DRAMs 22-1 to 22-4 by activating a row address strobe RAS-bar LOW. The memory sequencer 262 in response to control signals received from the BitBLT control 258, then activates the read enable signal RE-bar LOW, sequentially provides, for example, the first four destination column addresses A00–A09, starting with an address corresponding to the destination start address, on the internal address bus 202, sequentially strobes the provided four destination column addresses into each of the column address buffers of the DRAMs 22-1 to 22-4 by activating LOW each of the column address strobe signals, CAS(0)-bar to CAS(7)-bar, sequentially reads the first four 8-bytes of 888-RGB color-space formatted data from the display memory 22 corresponding to the first four destination column addresses, and sequentially stores the first four 8-bytes of 888-RGB color-space formatted data corresponding to the first four destination column addresses into the destination latches 265 (assumed in this example to be at least four 8-bytes deep).

Between time t0 and t1, a number of functions are performed under the control of the BitBLT control 258. The MUX 254 passes a first byte of monochrome data from the CPU write buffer 253 to the bit align circuit 256, as described in reference to FIG. 10. The bit align circuit 256 generates the values of the column address strobe values, CAV(0)-bar to CAV(7)-bar, for a first data cycle as described in reference to FIGS. 14 and 15, and passes the generated values to the memory sequencer 262.

At time t1, the BitBLT control 258 generates enable signals e0–e6 causing selected ones of flip-flops, 2564-0 to 2564-6, to store the data provided at their corresponding D-inputs. Thus, data generated during the first data cycle are stored in the selected ones of flip-flops, 2564-0 to set of column the first set of column address strobe values, CAV (0)-bar to CAV(7)-bar, have been provided to the memory sequencer 262. And as will be subsequently illustrated, will be combined with data generated during a second data cycle to generate the second set of column address strobe values, CAV(0)-bar to CAV(7)-bar.

Before time t2, the color expand circuit 255 provides an 8 byte RGB-color pattern of foreground colors matched to the RGB-color pattern of the first 8-bytes of data stored in the destination latches 265, to the raster operation circuit 261, and the raster operation circuit 261 logically combines the data received from the color expand circuit 255 and the first 8-bytes of data stored in the destination latches 265 in response to a raster operation command stored in the register 224-15, and provides the result to the graphics controller 259.

At time t2, the first data cycle is completed. At that time, a second data cycle is initiated concurrently with a first write cycle for writing the data resulting from the first data cycle into the display memory 22. The second data cycle is initiated once again by a number of functions being performed under the control of the BitBLT control 258. The bit align circuit 256 generates the values of a second set of column address strobe values, CAV(0)-bar to CAV(7)-bar, as described in reference to FIGS. 14 and 15, and passes the generated values to the memory sequencer 262. The color expand circuit 255 provides an 8 byte RGB-color pattern of foreground colors matched to the RGB-color pattern of the second 8-bytes of data stored in the destination latches 265, to the raster operation circuit 261. The raster operation circuit 261 logically combines the data received from the color expand circuit 255 and the second 8-bytes of data stored in the destination latches 265 in response to the raster operation command stored in the register 224-15, and provides the new result to the graphics controller 259. For the first write cycle (corresponding to time t2–t4 in FIG. 17, for example) is initiated by the memory sequencer 262 providing the column address A00–A08 for the first 8 byte wide write to the display memory 22, on the internal address bus 202, and the graphics controller 259 providing the first 8 bytes of data resulting from the first data cycle to data lines D00–D63 of the internal data bus 210.

At time 3, the second data cycle is completed by the BitBLT control 258 generating enable signals e0–e6 causing selected ones of flip-flops, 2564-0 to 2564-6, to store the data provided at their corresponding D-inputs during the second data cycle. As a result, data generated during the second data cycle is stored in the selected ones of flip-flops, 2564-0 to 2564-6, after the second set of column address strobe values, CAV(0)-bar to CAV(7)-bar, have been provided to the memory sequencer 262, and will be combined with data generated during a third data cycle to generate the third set of column address strobe values, CAV(0)-bar to CAV(7)-bar. In addition, the first write cycle is completed by memory sequencer 262 in response to timing and/or control signals from the BitBLT control 258, strobing the first destination column address A00–A08 into the column address buffers of the DRAMs 22-1 to 22-4 which have corresponding column address strobes CAS(0)-bar to CAS (7)-bar going LOW, and storing the first 8 bytes of data resulting from the first data cycle into the data-in buffers of the DRAMs 22-1 to 22-4 which have corresponding column address strobes CAS(0)-bar to CAS(7)-bar going LOW. As previously described, the column address A00–A08 is generated by the memory sequencer 262 in response to one or more control signals received from the BitBLT control 258, and the column address strobe signals, CAS(0)-bar to CAS (7)-bar, are generated by the memory sequencer 262 in response to one or more control signals received from the BitBLT control 258 indicating their timing, and the column address strobe values, CAV(0)-bar to CAV(7)-bar, received from the bit align circuit 256 indicating their respective values for the first write cycle, as previously described in reference to FIGS. 14 and 15.

At times t4–t6 and t6–t8, the third and fourth data cycles, and second and third write cycles are respectively performed in the same manner as described in reference to the second data cycle and first write cycle during time t2–t4. After the fourth data cycle, however, the memory sequencer 262 performs another four successive reads to the display memory to refill the destination latches 265 with new data from the next four destination addresses in the same manner as described in reference to successively reading the first four destination addresses in the display memory 22 prior to time t0. In each new data cycle, a new column address A00–A08 is generated by the BitBLT control 258, for example, incrementing the previous column address. If the incremented column address is greater than the width of the destination area as indicated, for example, by the contents of the width register 224-7, a new starting address is calculated by the BitBLT control 258, for example, using conventional techniques. If the incremented row address is greater than the height of the destination area as indicated, for example, by the contents of the height register 224-8, the BitBLT control 258 writes the results of the last data cycle completed, then terminates the BitBLT operation by changing the busy flag indicated, for example, by the contents of the BitBLT start status register 224-14.

The memory clock ("clk") is shown in the top timing diagram of FIG. 17 to provide a reference to the other signals described therein. Based upon the memory clock, the BitBLT control 258 causes the memory sequencer 262 to generate the column addresses A00–A09 at the rising edge of every other clock signal, for example, and the column address strobe signals, CAS(0)bar to CAS(12)-bar, at the rising edge of the inbetween clock signals. In particular, if the first set of column addresses are generated at a first rising edge of the clock signal at time t2, the first set of column address strobe signals, CAS(0)-bar to CAS(12)-bar, corresponding to the first set of column addresses are generated at a following rising edge of the clock signal at time t3.

In addition, the BitBLT 258 also generates the enable signals, e0–e6, such that they occur in a data cycle preceding their corresponding column address strobe signals, CAS(0) -bar to CAS(12)-bar. In particular, if the first set of column address strobe signals, CAS(0)-bar to CAS(12)-bar, are generated at a rising edge of the clock signal at time t3, then the first set of enable signals, e0–e6, are generated by the BitBLT control 258 at the preceding rising edge of the clock signal at time t1.

In comparing the VGA controller 20 with its prior art counterpart, portions of which are illustrated, for example, in FIGS. 9*a*–9*c*, it is clear that the VGA controller 20 requires less circuitry for its operation than its prior art counterpart. As one example, the VGA controller 20 has eliminated the need for the large byte aligner depicted in FIG. 9*c* by performing its alignment function using the much smaller bit aligner depicted in FIG. 14. In particular, the large byte aligner of FIG. 9*c* employs 15 MUXs, 1110-00 to 1110-14, each receiving 8-bytes of data and passing one byte, whereas the smaller bit aligner of FIG. 14 employs 15 MUXS, 2562-00 to 2562-14, each receiving only 8-bits of data and passing one bit. Accordingly, an 8-to-1 reduction in such MUX circuitry is achieved. As another example, the VGA controller 20 only operates on foreground color data, thus eliminating the need for such circuitry as registers 1120, 1122, and 1124, and MUX 1106 depicted in FIG. 9*a*. Rather than operating on background colors for monochrome bits of a value "0", for example, the VGA controller 20 merely ignores these monochrome bits, thus effectively treating them as being transparent. In many applications, treating the background bits as being transparent is not only acceptable, but may even be desirable. If, however, the background bits are to be operated upon using background colors, the VGA controller 20 may make a second pass through the BitBLT operation with the source-invert signal to the exclusive-OR 1224 of FIG. 13 activated, and the appropriate background colors stored in the register 1230, 1232, and 1234 of FIG. 16.

Although the various aspects of the present invention have been described with respect to a preferred embodiment, it will be understood that the invention is entitled to full protection within the full scope of the appended claims.

What is claimed is:

1. A controller connected to a memory storing red, green, and blue color data for individual pixels of a display screen, comprising:

means for storing data indicative of predefined shades of red, green, and blue;

means for receiving monochrome color data for indicated pixels of said display screen;

means for receiving red, green, and blue color data from said memory, for said indicated pixels of said display screen;

means for logically combining said received color data and corresponding ones of said predefined shades of red, green, and blue; and means for generating a plurality of column address strobe signals from said received monochrome color data such that said generated plurality of column address strobe signals cause said logically combined color data to replace stored red, green, and blue color data in said memory for selected ones of said indicated pixels as determined by bit values of said monochrome color data.

2. The controller as recited in claim 1, said memory organized by addresses uniquely corresponding to said red, green, and blue color data for individual pixels of said display screen, wherein said means for logically combining said received color data and corresponding ones of said predefined shades of red, green, and blue, comprises:

means for generating a first plurality of select signals by decoding an address corresponding to one of said indicated pixels of said display screen;

multiplexing means responsive to said plurality of select signals for generating said corresponding ones of said predefined shades of red, green, and blue to be logically combined with said received color data; and means for logically combining said received color data and said corresponding ones of said predefined shades of red, green, and blue generated by said multiplexing means.

3. The controller as recited in claim 1, said memory organized by addresses uniquely corresponding to said red, green, and blue color data for individual pixels of said display screen, wherein said column address strobe signals generating means comprises:

means for generating a second plurality of select signals and a plurality of enable signals by decoding an address corresponding to one of said indicated pixels of said display screen;

means responsive to said second plurality of select signals for passing selected bits of said received monochrome color data; and means responsive to said plurality of enable signals for storing selected ones of said passed selected bits of said received monochrome color data.

4. The controller as recited in claim 3, wherein said means for generating a plurality of second select signals and a plurality of enable signals, provides said generated second plurality of select signals to said passing means and said generated plurality of enable signals to said storing means such that a time of providing said generated plurality of enable signals to said storing means is delayed from a time of providing said generated second plurality of select signals to said passing means.

5. The controller as recited in claim 4, wherein said column address strobe signals generating means further comprises:

means for generating a plurality of control signals by decoding an address corresponding to one of said indicated pixels of said display screen; and means responsive to said plurality of control signals for generating a plurality of column address strobe values respectively corresponding to said plurality of column address strobe signals from said selected bits of said received monochrome color data passed by said passing means, and data stored by said storing means.

6. The controller as recited in claim 5, wherein said plurality of control signals generating means provides said generated control signals to said plurality of column address strobe values generating means such that a time of providing said generated control signals is before said time of providing said generated enable signals to said storing means by said second plurality of select signals and plurality of enable signals generating means.

7. The controller as recited in claim 1, wherein said column address strobe signals generating means includes means responsive to a source-invert signal for inverting said received monochrome data, and generates said plurality of column address strobe signals from said inverted monochrome color data such that said generated plurality of column address strobe signals cause said logically combined color data to replace stored red, green, and blue color data in said memory for selected ones of said indicated pixels as determined by said inverted monochrome color data.

8. A method of performing a BitBLT operation on indicated pixels of a display screen, comprising:

receiving data indicative of predefined shades of red, green, and blue;

receiving monochrome color data for said indicated pixels of said display screen;

receiving red, green, and blue color data from a memory, for said indicated pixels of said display screen;

logically combining said received color data and corresponding ones of said predefined shades of red, green, and blue; and generating a plurality of column address strobe signals from said received monochrome color data such that said generated plurality of column address strobe signals cause said logically combined color data to replace stored red, green, and blue color data in said memory for selected ones of said indicated pixels as determined by bit values of said monochrome color data.

9. The method as recited in claim 8, wherein logically combining step comprises:

generating a plurality of select signals by decoding an address corresponding to one of said indicated pixels of said display screen;

generating in response to said plurality of select signals, said corresponding ones of said predefined shades of red, green, and blue to be logically combined with said received color data; and logically combining said received color data and said generated corresponding ones of said predefined shades of red, green, and blue.

10. The method as recited in claim 8, wherein said column address strobe signals generating step comprises:

generating a second plurality of select signals and a plurality of enable signals by decoding an address corresponding to one of said indicated pixels of said display screen;

passing in response to said plurality of select signals, selected bits of said received monochrome color data; and storing in response to said plurality of enable signals, selected ones of said passed selected bits of said received monochrome color data into a plurality of latches.

11. The method as recited in claim 10, wherein said selected ones storing step is performed after a time delay after said selected bits passing step.

12. The method as recited in claim 11, further comprising:

generating a plurality of control signals by decoding an address corresponding to one of said indicated pixels of said display screen; and generating in response to said plurality of control signals, a plurality of column address strobe values respectively corresponding to said plurality of column address strobe signals from said passed selected bits of said received monochrome color data and said data stored in said plurality of latches.

13. The method as recited in claim 12, wherein said column address strobe values generating step is performed after said selected bits passing step, and before said selected ones storing step.

14. The method as recited in claim 8, further comprising receiving a source-invert signal for inverting said received monochrome data, and wherein said plurality of column address strobe signals generating step comprises generating said plurality of column address strobe signals from said inverted monochrome color data such that said generated plurality of column address strobe signals cause said logically combined color data to replace stored red, green, and blue color data in said memory for selected ones of said indicated pixels as determined by said inverted monochrome color data.

15. A computer system comprising:

a host processor;

a display having a display screen with a number of pixels;

a memory storing red, green, and blue color data for individual pixels of said display screen; and a controller including means for storing data indicative of predefined shades of red, green, and blue; means for receiving monochrome color data for indicated pixels of said display screen; means for receiving red, green, and blue color data from said memory, for said indicated pixels of said display screen; means for logically combining said received color data and corresponding ones of said predefined shades of red, green, and blue; and means for generating a plurality of column address strobes from said received monochrome data such that said generated plurality of column address strobes cause said logically combined color data to replace stored red, green, and blue color data in said memory for selected ones of said indicated pixels as determined by bit values of said monochrome color data.

16. The computer system as recited in claim 15, said memory organized by addresses uniquely corresponding to said red, green, and blue color data for individual pixels of said display screen, wherein said means for logically combining said received color data and corresponding ones of said predefined shades of red, green, and blue, comprises:

means for generating a first plurality of select signals by decoding an address corresponding to one of said indicated pixels of said display screen;

multiplexing means responsive to said plurality of select signals for generating said corresponding ones of said predefined shades of red, green, and blue to be logically combined with said received color data; and means for logically combining said received color data and said corresponding ones of said predefined shades of red, green, and blue generated by said multiplexing means.

17. The computer system as recited in claim 15, said memory organized by addresses uniquely corresponding to said red, green, and blue color data for individual pixels of said display screen, wherein said column address strobe signals generating means comprises:

means for generating a second plurality of select signals and a plurality of enable signals by decoding an address corresponding to one of said indicated pixels of said display screen;

means responsive to said second plurality of select signals for passing selected bits of said received monochrome color data; and means responsive to said plurality of enable signals for storing selected ones of said passed selected bits of said received monochrome color data.

18. The computer system as recited in claim 17, wherein said means for generating a plurality of second select signals and a plurality of enable signals, provides said generated second plurality of select signals to said passing means and said generated plurality of enable signals to said storing means such that a time of providing said generated plurality of enable signals to said storing means is delayed from a time of providing said generated second plurality of select signals to said passing means.

19. The computer system as recited in claim 18, wherein said column address strobe signals generating means further comprises:

means for generating a plurality of control signals by decoding an address corresponding to one of said indicated pixels of said display screen; and means responsive to said plurality of control signals for generating a plurality of column address strobe values respectively corresponding to said plurality of column address strobe signals from said selected bits of said received monochrome color data passed by said passing means, and data stored by said storing means.

20. The computer system as recited in claim 19, wherein said plurality of control signals generating means provides said generated control signals to said plurality of column address strobe values generating means such that a time of providing said generated control signals is before said time of providing said generated enable signals to said storing means by said second plurality of select signals and plurality of enable signals generating means.

21. The computer system as recited in claim 15, wherein said column address strobe signals generating means includes means responsive to a source-invert signal for inverting said received monochrome data, and generates said plurality of column address strobe signals from said inverted monochrome color data such that said generated plurality of column address strobe signals cause said logically combined color data to replace stored red, green, and blue color data in said memory for selected ones of said indicated pixels as determined by said inverted monochrome color data.

* * * * *